United States Patent [19]

Orain

[11] 3,999,417

[45] Dec. 28, 1976

[54] APPARATUS FOR COLD-FORMING METAL WORKPIECES

[75] Inventor: Michel Orain, Conflans-Sainte-Honorine, France

[73] Assignee: Glaenzer Spicer, Poissy, France

[22] Filed: Sept. 12, 1975

[21] Appl. No.: 612,628

Related U.S. Application Data

[63] Continuation-in-part of Ser. No. 458,227, April 5, 1974, Pat. No. 3,908,430.

[30] Foreign Application Priority Data

Apr. 17, 1973 France ..... 73.13830
Feb. 7, 1975 France ..... 73.03992

[52] U.S. Cl. ..... 72/353
[51] Int. Cl.[2] ..... B21J 9/02
[58] Field of Search ..... 72/352, 353, 354, 355, 72/356, 357, 358, 359, 360, 401, 402

[56] References Cited

UNITED STATES PATENTS

| | | | |
|---|---|---|---|
| 2,787,828 | 4/1957 | Cousino | 29/553 |
| 2,978,932 | 4/1961 | Frueauff, Jr. | 72/354 |
| 3,355,930 | 12/1967 | Fedorov | 72/401 |
| 3,455,140 | 7/1969 | Galan et al. | 72/402 X |
| 3,583,198 | 6/1971 | Drallmeier | 72/358 |

FOREIGN PATENTS OR APPLICATIONS

| | | |
|---|---|---|
| 1,065,251 | 3/1960 | Germany |

*Primary Examiner*—Milton S. Mehr
*Attorney, Agent, or Firm*—Baldwin, Wight & Brown

[57] ABSTRACT

A setup for use in a press for cold-forming metal parts, such as tripods of universal joints having a central body and radially projecting portions, from a cylindrical billet. A first setup is provided for forming an intermediate workpiece which may then be finished in a second setup. In the first setup the die sectors which make up the die are mounted on rams which are slidably mounted on slotted members between a spaced apart position when the press piston is in its raised position and a clamped together position by means of a toggle mechanism. Punches are provided on the table and the piston which compress the starting billet thereby extruding the metal into channels in each of the die sectors. In the second setup upper and lower die halves are carried respectively by the piston and the table of the press. The die halves have channels adapted to receive the various portions of an intermediate workpiece. Vertical and horizontal punches are provided for finishing various recesses and surfaces of the intermediate workpiece. The die halves are clamped together without working force of the press which may reach 100–200 metric tons.

10 Claims, 40 Drawing Figures

FIG.23
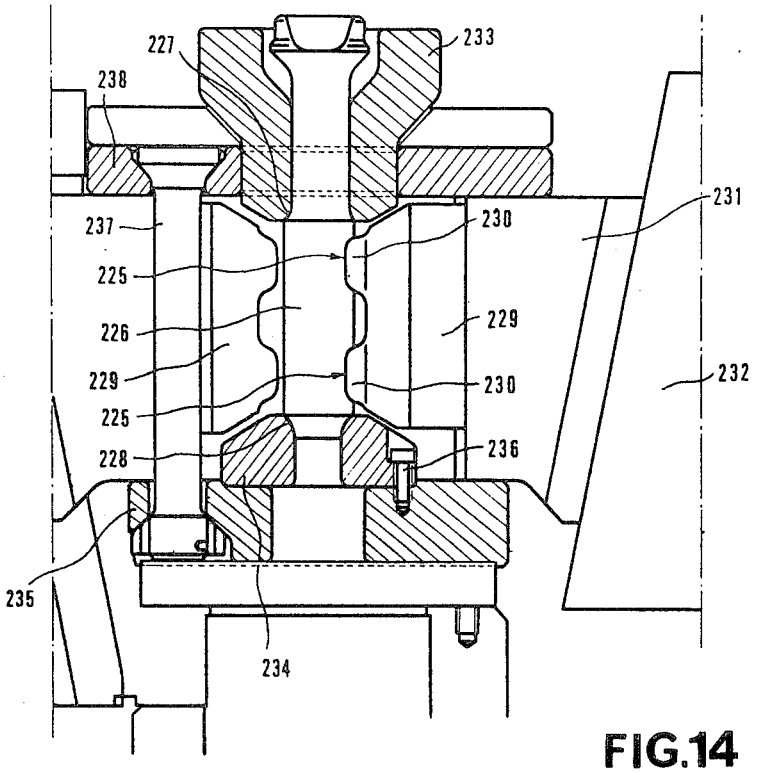
FIG.14
FIG.24
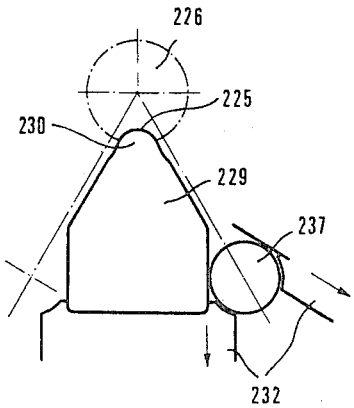
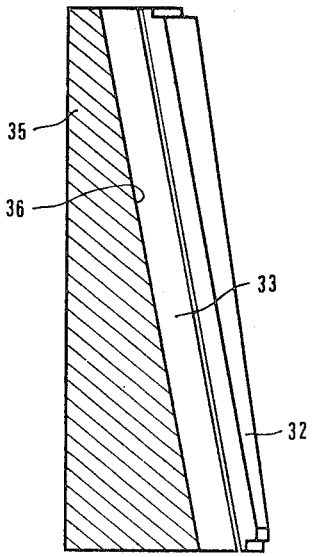

APPARATUS FOR COLD-FORMING METAL WORKPIECES

This application is a continuation-in-part of my application Ser. No. 458,227 filed Apr. 5, 1974, now U.S. Pat. No. 3,908,430, granted Sept. 30, 1975.

DETAILED DESCRIPTION OF THE INVENTION

The present invention relates to cold-forming metal workpieces, particularly steel workpieces, for the manufacture of parts without removing material.

Known methods of cold-forming steel and other hard metals, such as extrusion, sizing, drawing, etc., apply to pieces of revolution having a constant or substantially constant cross-sections varying within narrow limits. Such pieces or parts could in fact have protuberances, notches, serrations which make up only a small percentage of the total volume of the part and are only slight relative projections.

The present invention proposes the cold-forming of cylindrical or substantially cylindrical billets, a family of workpieces which up till now have been roughed out by hot die then machined over their entire surface by removing metal chips with turning mills, drills, broaches, milling cutters, etc. This family of workpieces comprises those having a main axis and substantial radially projecting portions more or less equally spaced around the main axis.

A more particular aspect of the invention consists in apparatus which enables this result to be achieved by producing a piece such as an intermediate rough shape workpiece from a parting billet or a desired final piece from the same starting billet or from said rough shape workpiece.

The apparatus according to the invention essentially comprises, on the one hand, a first assembly including a multipart die adapted to form, when bringing the die-parts together, a cavity which corresponds to the shape of the piece to be formed, this cavity having a central chamber and radially projecting channels adapted to receive corresponding portions of the piece to be formed and, on the other hand, a second assembly including punches adapted to extend inside said die through openings specially agenced in said die parts from effecting deformations of the contacts thereof, the component parts of these assemblies being respectively carried by the press piston and table and the component parts of the other assembly being carried by rams or blocks sliding in a parallel direction with the axis of the press in oblique guide-slots arranged about the axis of the piston between the upper and lower plate members urged toward each other, said blocks being arranged to be driven by the piston along at least part of its work stroke after meeting in their resultant movement in their guide-slots to approach one another, this movement toward one another following the closing movement of the die when the parts thereof are carried by the press piston and table and the guide-slots supporting the punches which then penetrate into the closed die, in preceding this penetration movement when the punches are supported by the press piston and table and the blocks support the component parts of the die.

In case of starting with a cylindrical billet to obtain an intermediate workpiece or a nearly finished workpiece, if need be, the die preferably comprising as many sectors as there are radial projections to be formed on the central body of the piece, a transverse boring in the direction of plane extending radially with respect to the axis of displacement of the press piston being provided in each die sector and opening in a narrowed portion forming an extrusion throat on a part-cylindrical cavity, the combination of the part-cylindrical cavities of each of the die sectors forms a cavity coaxial with the press piston, the cavity being open at its ends, adapted to receive the starting billet, and having a section along the axis immediately adjacent to the openings which is at least in part the section of the central body of the piece to be obtained, each die sector being carried by an obliquely sliding block, while two punches respectively borne by the press piston and the press table along the axis of the piston are adapted to penetrate into said cavity, so compressing the starting billet.

In this case, each die-sector-carrying block is preferably connected to the press piston by a toggle joint comprising two levers pivoted to each other, one of the levers also being pivoted on the block and the other lever also being pivoted on a socket slidably mounted on the press piston with a compression spring interposed therebetween for urging the socket towards the blocks, the sliding socket being arranged to bear against the blocks and displace them along their guide-rods during the downward movement of the piston, means being provided for preventing the common pivot point of the levers of the toggle joint to move substantially away from the position in which the distance between the sliding socket and the blocks is at its maximum, and then enabling this common pivot point to move away from the position in order to come in contact under the retaining abutment when the die sectors are moved into contact with one another for clamping the die sectors.

In case of finishing an intermediate workpiece, the die is preferably composed with two die halves borne respectively by the press piston and the press table and adapted to receive the die workpiece in an array of radially extending channels disposed in the faces of the half-dies adapted to come into contact with each other, punches adapted to penetrate into the channels being borne by blocks being adapted to slide parallel to the axis of the piston along two oblique guide-slots, the half-dies being supported by members movable along the axis of the press piston and connected, for the upper half-die to the piston to an interposed compression spring urging the upper half-die towards the lower half-die, and the lower half-die, to means enabling the sliding movement of the shaft in the table in response to the piston until the position in which the shaft is secured against movement, by means of horizontal cross bars and vertical tie rods, to a member adapted to abut against an element integral with the press piston during the forming of the piston.

The device according to the invention enables, as it will be shown hereinafter, a manufacture of pieces by cold deformation without removing material under conditions which, compared to conventional methods, have a great number of advantages which can be resumed as follows:

1. Elimination of die forging a rough workpiece: according to the invention, the raw material is employed directly as round bars sheared off to the desired length in order to obtain the starting billets;

2. Elimination of all losses of metal, since the weight of the ultimate piece is equal to the weight of the billet;

3. Elimination of numerous machining operations: drilling, facing, boring, lathe work, which are each repeated as many times as the number of radial axes;

Indeed, according to the invention, the portions along the main axis and the radial axes are obtained simultaneously.

4. Elimination of adjustment and checking operations associated with machining since the cold-forming tools yield very uniform dimensions as long as they are in use. The only intervention necessary is to put them out of service.

5. High speed manufacture : the production rate of such presses is in the range of 500 – 1000 pieces per hour for the proposed application i.e., about 5 to 10 times greater than the production rates with chip removal machine tools;

6. Greatly reduced investments since one or two presses are sufficient to transform a cylindrical billet into an achieved piece and since the production rate is increased;

7. The quality of the pieces produced is higher than by conventional methods. Indeed:

a. the grain structure is optimum;

b. the condition of the surfaces is excellent so that in many cases fine griding may be dispensed with;

c. the accuracy of certain dimensions is obtained more easily than with machine tools working at very high production rates;

d. the evolutive shapes of the produced pieces such as adjusting by fillets of various surface types are ensured with perfect constancy and without scratching or tearing out as it ocurrs with conventional machining methods when the cutting tools start to wear out.

Various examples of parts which may be obtained according to the invention and apparatus for producing such pieces are illustrated in the accompanying drawings, in which:

FIG. 14 is a cross-sectional view taken on the line XIV—XIV of FIG. 13;

FIG. 23 is a vertical sectional view of setup for forming in grooves of part-circular section with sperical ends, in a generally cylindrical piece;

FIG. 24 is a schematic plan view of a detail of FIG. 23;

Figure 1:
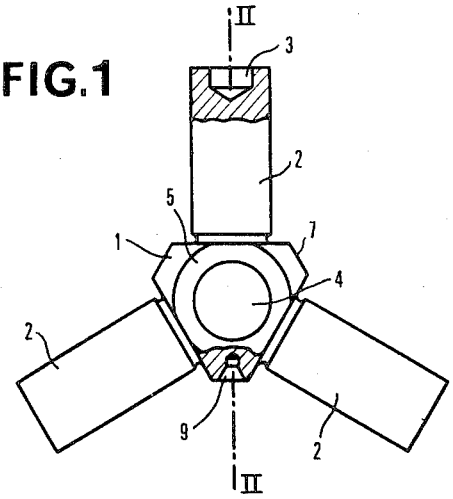
FIG. 1 is an elevational side view with cutaway portions of a so-called "tripod" or three-arm member of a constant velocity universal joint produced according to conventional machining methods.

First of all, we shall consider the machining of a so-called tripod which is a component part of a constant velocity universal joint for driving the wheels of a front-wheel drive automobile. This piece comprises a central body 1 carrying three arms 2, the axes of the arms being located in a single plane and angularly spaced 120° from one another. Rollers (not shown) are adapted to be mounted for rotation on the arms and sliding along the axes of the arms. A cylindrical cavity 3 (see FIG. 3) is provided in the end of each arm for securing the tripod in a bore coaxial to the stub axle of a wheel of the vehicle with a stud provided in the stub axle for that purpose. A blind bore 4 is provided in the central body 1, a face 5 being provided around the open end of a blind bore 4 and a spherical dome 6 at the end of the blind bore 4 opposite the face 5, the axes of the arms intersect at a point in line with the center of the spherical dome 6. The blind bore 4 and the spherical dome 6 are provided to maintain the tripod axially while giving it freedom to oscillate about the above-mentioned point of intersection.

Figure 4:
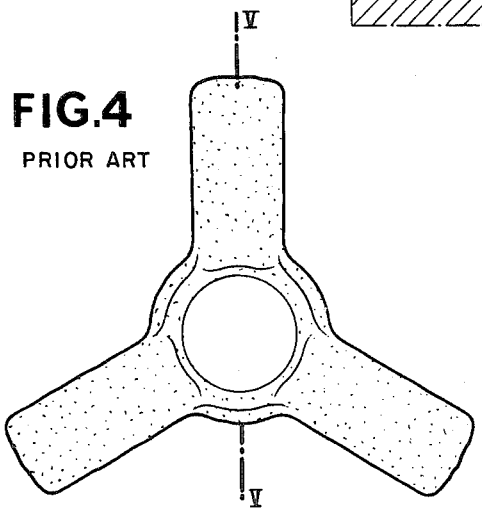
FIG.4 PRIOR ART
FIG. 4 is a view corresponding to FIG. 1 of an intermediate rough workpiece from which the piece shown in FIG. 1 is produced.
Figure 5:
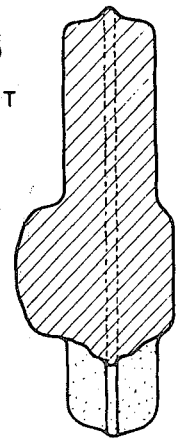
FIG.5 PRIOR ART
FIG. 5 is a cross-sectional view taken on the line V—V in FIG. 4.

The manufacture of such a tripod by conventional machining comprises the following steps:

a. Die forging a rough workpiece with dimensions within 1 millimeter of the final dimensions, the workpiece thus produced being shown in FIGS. 4 and 5;

b. Scaling by shotblasting and then checking the workpiece before passing it on to a machine tool;

c. Drilling a rough central hole 4 and spot-facing the open end thereof;

d. Milling the outside of the arms to the desired length and then milling flats 7;

e. Roughing out and finishing three bores 3 with their countersinks or chamfers 8 (FIG. 3) and three "centers" or recesses 9 which in association with the opposed bores 3 at the ends of the arms enable the turning and the subsequent grinding of the arms;

f. Consecutively turning the three arms 2 with chamfers 10 at their free ends; and g. Turning the spherical dome 6 and fine grinding it.

Figure 6:
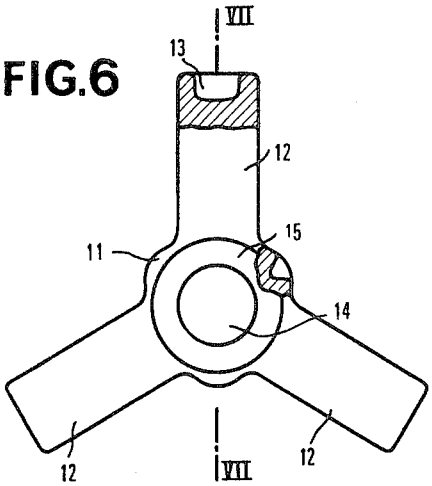
FIG. 6 is a view similar to that of FIG. 1 of the same part when it is obtained according to the invention.
Figure 7:
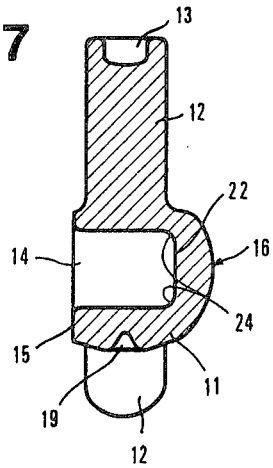
FIG. 7 is a cross-sectional view taken on the line VII—VII in FIG. 6.
Figure 8:
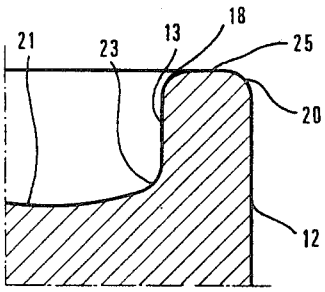
FIG. 8 is a detail on a larger scale of a piece of FIG. 7.
Figure 9:
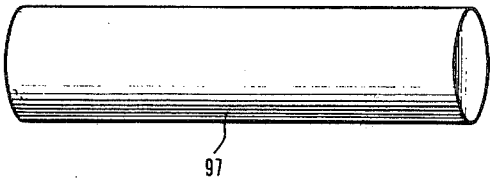
FIG. 9 shows the steel billet which is the raw material piece for producing the piece shown in FIGS. 6 and 7.

The same tripod piece may be turned out as shown in FIGS. 6–8 by a tool setup according to the invention in only two steps starting with a cylindrical billet as shown in FIG. 9 obtained by shearing off a bar of annealed steel straight from the steelworks.

Figure 2:
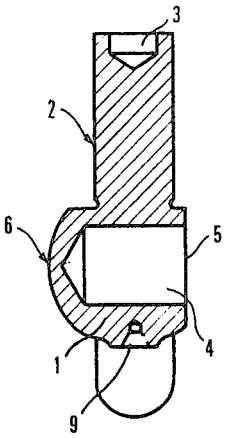
FIG. 2 is a cross-sectional view taken on the line II—II in FIG. 1.
Figure 3:
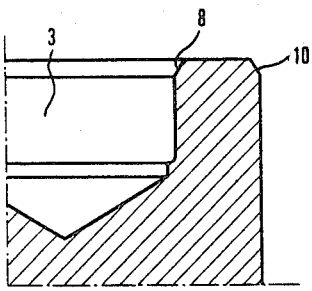
FIG. 3 is a detail on a larger scale of FIG. 2.

In FIGS. 6–8 pieces similar to the pieces in FIGS. 1–3 are designated by the same reference numerals plus ten.

Not only are the steps of manufacture, and therefore the production costs of such a piece, considerably reduced compared to what was possible with the former method, but in addition, the pieces formed by the tool setup according to the invention are improved from the point of view of mechanical strength owing to the fact that the bores of the holes 13 at the ends of the arms and the central bore 14 in the central body 11 of the piece are connected to their substantially flat bottoms 21 and 22, respectively, by fillets 23 and 24; similarly, the faces 25 at the free ends of the arms are connected to the outer surface of their respective arms and lateral surface of the bores 13 by the rounds or curved connecting zones 18 and 20 which replace the chamfers 8 and 10; and finally, the contours of the centers or recesses 19 are also rounded. It is known that fillets and rounds of the above types avoid stress concentrations which are caused by presence of more or less sharp angles. Further, the rounds 18 at the open ends of the bores 13 at the free ends of the arms improve the quality of the force fit of the ends of the arms in corresponding stud pins in the bore of the stub axle to be driven. Such rounds and fillets would be very difficult to mass produce by conventional methods.

Moreover, the accuracy and quality of the surfaces of the bores 13 in the ends of the arms as well as that of the central bore 14 are very much better than those produced by chip removal and do not require finishing steps. The spherical dome 16 is also obtained in a single pass and does not need subsequent fine grinding. Only the grinding of the arms after quenching the piece may be necessary, which is the reason for the provision of the centers 19.

Finally, as a complementary advantage, the grain structure of the steel resulting from forming with the setup according to the invention is optimal and also makes the piece more reliable and improves its performance.

Figure 10:
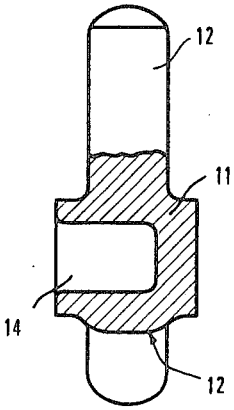
FIG. 10 is a side elevational view with cutaway portions along the axis of one of the arms of the tripod of an intermediary workpiece, obtained according to the invention, before the finishing pass at the end of which the piece shown in FIGS. 6 and 7 is obtained.

Thus, as previously indicated, the piece in question is obtained by means of a tool setup according to the invention in only two passes, viz., a pass for forming a rough workpiece such as shown in FIG. 10 having a central body 11, three arms 12 and the central bore 14 in the body 11, and a second pass for forming the bores 13 in the ends of the arms, the centers 19 and the spherical dome 16.

The first pass is carried out with the tool setup shown in FIGS. 11–14.

This tool setup is mounted in a press, only the piston 26 and the table 27 of the press being shown. The metal forming or working parts of the setup comprise a die formed in three identical sectors or quadrants 28 (see FIG. 12 in particular) and two punches 29 and 30.

Each of the sectors 28 making up the die is fixed by a bolt 31 to a block 32 having a T-head 33 which is engaged in an inclined guide-slot 34 formed in a slotted member 35 having a concave face 36 on which the block 33 is carried, the concave face 36 being inclined parallel to the guide-slot 34 at an angle $\alpha$ of about 12° from the vertical. The slotted members 35 are held at their lower ends in a circular recess in a plate member 37 and at their upper ends in a corresponding recess in a movable plate member 38. The recess in the movable plate member also has a shoulder 39 against which the heads of the slotted members 35 bear. The movable plate members 37 and 38 are urged toward each other by the tie bolt 40 clamping the slotted member 35 therebetween. The slotted members 35 are arranged so that their median planes make 120° angles relative to one another, the spacing between the slot members being maintained by spacers 41. Each block 32 carries a yoke 42 on which a pin 43 is pivotally mounted and retained thereon by a washer 44 which is retained longitudinally by a cotter pin 45. The block also has a pawl 46 comprising at its upper end a part-cylindrical surface 46*a*, having the point A as a center and a radius R, and a lug 47, on which a telescopic link is pivotally mounted, formed of a yoke 48 pivotally mounted on a lug 47 about a pin 49 which is extended by a teat screw 50 and a similar member comprising a teat screw 51 extending a yoke 52 which pivots about a pin 53 in a notch 54 at a periphery of a sliding sleeve 55 which is slidably mounted on the piston column 56 which is in threaded engagement with the extension 57 of the piston of the press 26. The two teat screws 50 and 51 of the telescopic line 48–52 are connected together by a threaded sleeve 58 for adjusting the length of the telescopic link. The upper cylindrical surface 46a of the pawl 46 is adapted to be engaged, as indicated hereinafter, under a bearing surface 59 along the underside of an abutment member 60 which is held in the recess in the plate member 38 above the guide-slots 35.

The lower end of a sliding sleeve 55 is in threaded engagement with a threaded adjustment ring 61 which comes into abutment, through an interposed ring 62 acting as a liner, with a shoulder 63 on the sleeve 55, the adjustment ring 61 being adapted to come into abutment with the upper face of the yokes 42 on the blocks 32 at the end of the stroke of the press, as will be indicated hereinafter.

As annular flanged collar 64 engages the lower end of the piston column 56 and is held under the piston column by bolts 65, the outer surface of the collar 64 is shaped to be received, as will be described hereinafter, inside an annular centering member 66 carried by the yokes 42 on the blocks 32. A spacer washer 68 used as a liner is maintained under the annular flanged member 64 by screws 67 and is adapted to abut against the upper surface of the die sectors 28 at the end of the press stroke, as will be described hereinafter.

The annular flanged collar 64 also maintains the punch 29 under the lower end of the piston column 56.

Further, a compression spring 69 is disposed between a shoulder 70 which is formed on the extension 57 of the piston and a shoulder 71 formed in the sliding sleeve 55 above notches 54 receiving the end of the telescopic link 48–52. (To simplify FIG. 11 the telescopic link is shown very schematically on the left-hand side of FIG. 11.)

The annular plate member 37 carries the slotted members 35. A tapped hole 72 is formed in center of the plate member 37 and a threaded socket or sleeve 73 threadedly engages the tapped hole 72 and has an axial bore 74 in which a column 75, fastened to the press table 27 by a slot 76, is received. Three compression springs 77 are disposed between the plate member 37 and the press table 27 and spaced 120° from one another and bear against the underside of the plate member 37 through the adjustment spacer 78. The spring force or flexibility of the combination of three compression springs 77 is equal to that of the spring 69 interposed between the piston extension 57 and the sliding sleeve 55 which slides along the plunger column 56. The end of the up-stroke of the plate member 37 is determined by the position of the tie bolts 79 threadably engaging the table 27 of the press.

A central recess 80 in provided in the upper end of the column 75 in which the butt end of the lower punch 30 is received, the lower punch 30 being maintained by a ring 81 fastened to the upper end of the column 75 by bolts 82. Another ring 83 overlies the ring 81 and is held by screws 84, this ring 83 functioning as a liner on which the sectors 28 of the die are supported at the end of the piston stroke, as will be described below.

Each die sector 28 is of generally pentagonal shape with a flat base adapted to come into engagement with its associated block 32 and opposite the flat base two faces 89 making 30° angles with the base, whereby the faces 89 of adjacent die sectors come into contact against one another along planes spaced by 120° when brought together. A cylindrical chamber, or cavity 90 is formed by the portions connecting the inclined faces 89 of each of the die sectors, the diameter of the cylindrical chamber of cavity 90 corresponding to that of the central body 1 of the piece to be formed (FIGS. 6, 7 and 9). The cylindrical chamber 90 communicating with a cylindrical boring 91 the axis of which perpendicular to the common vertical axis of the three die sectors 28 in their closed position, is located along the median plane of the rectangular base of each die sector. This boring 91 comprises at its end, communicating with the chamber 90, a narrowed portion forming a die throat and at their opposite ends a tapped portion 93 in which the bolt 31 is threadedly engaged, the end **31*a* of the bolt 31** acting as a stop as will be described hereinafter.

The upper punch 29 and the lower punch 30, the other elements of the tool setup in combination with the die sectors 28, having diameters corresponding to the cylindrical chamber 90 between three die sectors 28 when they are brought together. The end face 94 of the upper punch 29 has an axial projection 95, the outer diameter of which is equal to the inner diameter of the central bore 14 in the piece body 11 (FIGS. 6, 7 and 10) and the length of which is equal to the depth of the bore. The axial extension 95 is connected to the end face 94 of the punch 29 by a fillet and its end ridge is rounded to correspond to the rounds which must be provided at the open end of the bore 14 and the connecting zone between the lateral walls and the bottom of the bore. As for the lower punch, it has a flat face 96 at its upper end.

In order to obtain the intermediate workpiece as shown in FIG. 10 with the tool setup as described above, the operation is as follows:

When the press is opened, i.e., the press piston 26 in its extreme raised position, the die blocks 32 are also in their raised position. The die blocks are brought to their raised position by the linkage comprising the telescopic links 48-52 and the pawls 46, the pawls 46 then being substantially vertical and in abutment against a ring 85 fastened by screws 86 to an annular flange 87 which in turn is fastened by screws 88 to the upper face of the upper plate member 38 for maintaining the slotted members 35. The die sectors 28 are then farthest from one another (left-hand side of FIG. 11).

The cylindrical starting billet having a diameter equal to that of the axial chamber (FIG. 9) is then placed on the upper face 96 of the lower punch 30 (which may be slightly magnetized to ensure the billet being held in a vertical position). The billet may also be introduced a little later, just before the closing of the die sectors 28, as will be described hereinafter.

The press piston 26 then starts its downward movement which drives the telescopic links 48–52 downwardly with the pawls 46 and the blocks 32 and their die sectors 28. As the blocks 32 slide along the inclined surface of their respective slotted members 35, the die sectors 28 move progressively toward one another until their inclined faces 89 come in contact with one another. At the same time, the upper cylindrical surfaces 46a of the pawls which are thrust outwardly by the toggle effect due to the telescopic links 48–52 engage under the circular bearing surface 59 of the abutment member 60; the upper cylindrical surfaces **46*a* are thus forcibly held in this position by the telescopic links. The curvature center A of the circular bearing surface 59 and center of rotation B of the pawl 46** are offset in such a manner that the wedging effect caused by the telescopic links 48-52 strenuously prestressed the die sectors 28. The prestressed force is limited by the abutment of the sliding sleeve 55 against the yokes 42 on the blocks 32 by means of the threaded adjustment ring 61 the uppermost position of which is determined by the liner 62.

From the preceding movement it is seen that before the prestress strains the die sectors 28, they must come into contact with each other before the end 95 of the upper punch 29 reaches the top of the billet 97 and the prestress, resulting from the engagement of the upper cylindrical surfaces 46a of the pawls 46 under the abutment members 60, is effective when the punch 29 starts to compress the billet 97 closed in the axial chamber formed at the center of the die sectors 28.

It should be noted here that instead of placing the billet on the lower punch 30, which may be magnetized for this reason before the locking operations of the die, it is possible to wait for the die sectors to be almost in contact with one another, the piston 26 with the punch 29 not being so low as to interfere with the introduction of the billet. The press must, of course, be temporarily stopped at this moment, in the desired loading position.

As the press piston continues its down stroke and the sliding sleeve 55 held against vertical displacement by abutting against the threaded adjustment ring 61 on the yokes 42, the spring 69 starts being compressed. The adjustment offered by the threaded adjustment ring 61 and the shim 62 is such that, taking into account the thickness of the spacers 78 with which the springs 77 on the movable lower plate member 37 come into contact, the compression of the spring 69 and the springs 77 begins at the same time. From this fact, as previously mentioned, the spring force or flexibility of the group of springs is equal to that of the spring 69; when the upper punch 29 moves downwards at the speed of the piston 26, the assembly comprising the three die sectors 28, the blocks 32, the slotted members 35 and the plate members 37 and 38 for holding the slotted members, moves downwards at one-half of said speed and the lower punch 30 carried by the column 75 remains stationary with respect to the press table 27. Accordingly, each punch 29 and 30 undergoes a displacement relative to the die equal to one half the working stroke of compression of the billet. Under the action of this compression, the lower extension 95 of the upper punch 29 penetrates into the billet. At the same time, the metal of the billet tends to fill entirely the chamber 90 at the center of the three die sectors 28 and to flow through the throat portions 92 formed at the entrance to the borings 91 formed in the die sectors.

Figure 11:
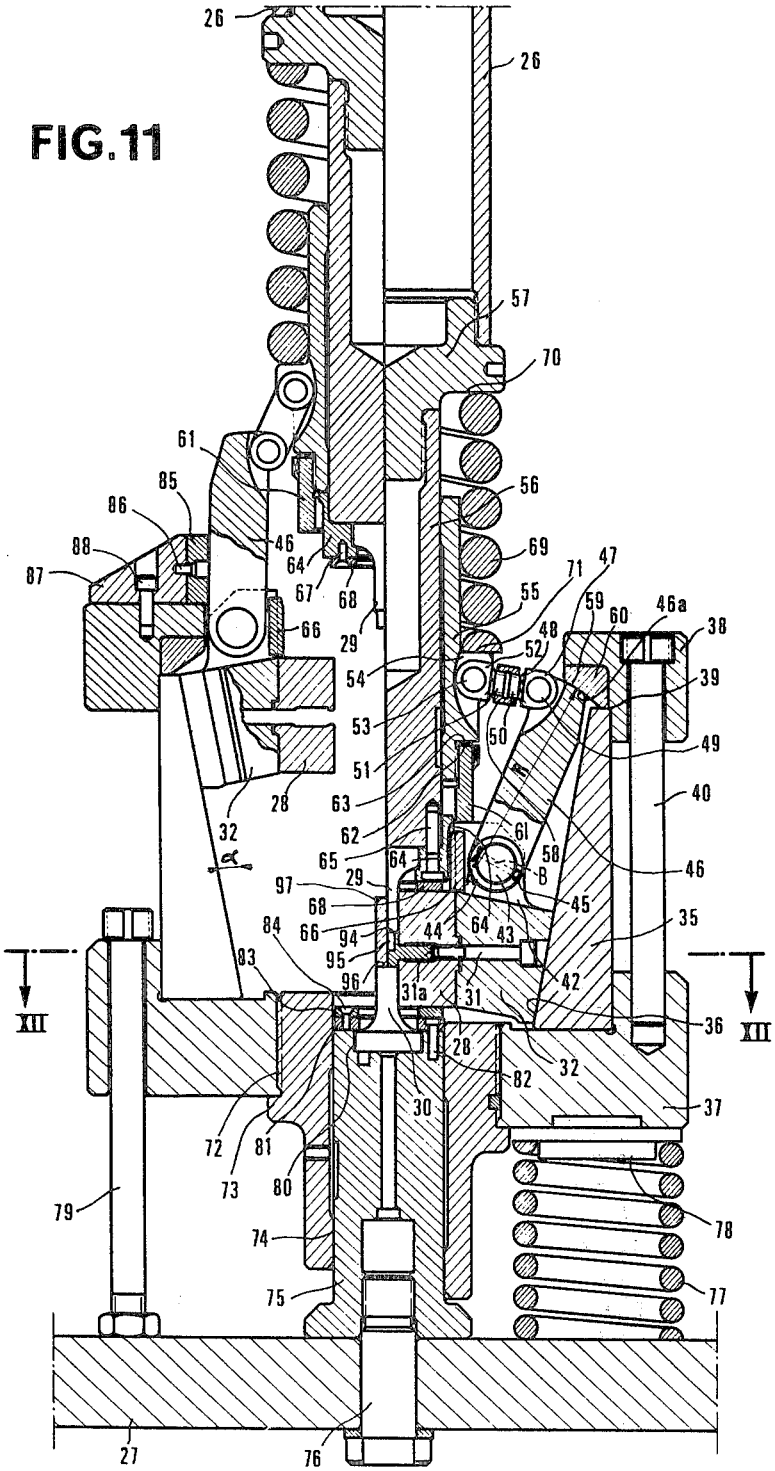
FIG. 11 is a vertical cross-sectional view of a press with a tool setup according to the invention for producing the rough workpiece shown in FIG. 10, at the left in FIG. 11 the press is shown at the end of its roughing out stroke.

The overall stroke of the punches and the die sectors is limited by the spacer washer 68, acting as an abutment and carried by the flange 64 topping the end of the piston column 56 on the three die sectors 28 which in turn rest on the ring 83, fixed to the ring 81 fixed to the top of the column 75 on the press-table 27; in other words the various parts of the set-up are in the position shown at the right-hand side in FIG. 11. In this position, the extrusion lengths of the three arms of the intermediate tripod workpiece are adjusted by contact with the end of the screw 31*a*. It is also conceivable to form the end of the screw 31*a* so as to prepare, at the ends of the arms of the tripod, for subsequent forming or machining, or even, in the case of other kinds of parts, extruded extensions which could be obtained by providing borings, at the end of a member such as the bolt 31, with an extrusion span comparable to the span or throat 92 provided at the entrance to the borings 91, or even such a throat in an extension of said boring 91; all other end forming operations could be carried out in an analogous manner.

Once the step of forming the intermediate workpiece is completed, the press is returned to its initial position. During its return or up-stroke, the press-piston moves the sliding sleeve 55 upwards into abutment against the upper face of the flange 64 (see the left-hand side of FIG. 11). The sliding sleeve 55 drives the telescopic links 48–52 causing the unlocking of the pawls 46 which return to their vertical position moving the blocks 32 upwards. The blocks 32 move upward along the guide-slots 34 in the members 35, causing the die sectors 28 to move away from one another. In this way, the cylindrical surfaces of the arms of the tripod receive, at the same time they withdrawn from the borings 91, a finishing sizing or calibration during the return pass through the throats 92; this finishing step may allow grinding after heat treatment to be dispensed with.

It is noted that the adjusting ring 58 for adjusting the length of each of the telescopic links 48–52, enables, in adjusting the lengths of said links, to provide the simultaneity of the raising of the three die sectors during the return or up stroke of the press. The accuracy of the relative position of the three die sectors 28 during this return stroke, in which the surface finishing of the arms of the tripods is effected, is of primary importance.

In addition, it is noted that the angular guiding and wedging of the blocks 32 about the vertical central axis of the setup as well as the operative pushing surface are displaced toward the periphery of the device along the slotted members 35, which are held radially by the two plate members 37 and 38, by bearing on the cylindrical surfaces of the internal recesses of the plate members.

During the combined compression-drawing-extrusion operation, the three die sectors 28 are strenuously squeezed against one another by a radial centripetal force F of the order of 100–200 metric tons. Consequently, the die sectors act as a one-piece die during the extrusion operation per se. Indeed, the inclined bearing faces 89 create, owing to the angles they make with the radial forces F, radial centripetal components which put the entire active central zone of the extrusion die under compression and thereby replace hooping commonly used for extrusion.

The strictness and the accuracy of the verticality and radiality of the extrusion sectors 28 are obtained easily owing to the descending position controlled by the central members: the ring 61 and the spacer 68. The principle of moving along guide-slots toward the exterior of the assembly frees the central area of the setup, thereby leaving the necessary and sufficient space for adequately dimensioning the working parts and ensuring their having suitable fatigue strength. The sliding surfaces between the blocks 32 and the slotted members 35 thus may be very amply dimensioned as required.

This arrangement and the construction principle used to ensure the perfectly synchronous advance of the application of radial forces and strictly determined positions, also permits numerous variations in use, for example, by modifying the number of guide-slots or slotted members and blocks, which could be standardized to be easily exchanged, between the plate members 37 and 38.

The device which has just been described enables the following press steps to be obtained without any interruption:

a. feeding (the die sectors being open)

b. closing the die sectors wedged against one another;

c. drawing or extrusion operation with controlled feed distribution;

d. sizing of finishing and ejection of the workpiece.

The device is robust and simple in view of the forces it may develop and the accuracy of the displacements during operation. The assembly of the device, its adjustments and the replacement of its parts are all easy.

The second or finishing pass is effected by means of a tool set-up shown in FIGS. 15–22. The reason for the finishing pass is the machining of the intermediate workpiece shown in FIG. 10 in order to obtain the finished tripod shown in FIGS. 6 and 7 by simultaneously effecting:

a. longitudinal dimensioning of the three arms 12;

b. forming and sizing the bores 13 at the ends of the arms with the rounded edges or rounds 18, 20 and 21;

c. forming the spherical dome 16 on the central body 11 with a surface finish equivalent to a finely ground surface;

d. sizing the central bore 14;

e. forming centers 19 in the central body 11 with a view to supporting the tripod during possible later grinding after cementation heat treatment.

The tool set-up for carrying out the finishing pass is, as in the case of the tool set-up for obtaining the intermediary workpiece, mounted on a press, the frame of which comprising the uprights 100, an upper cross member 101 carrying the piston-and-cylinder unit or jack 102 for operating the piston 103 and a table 104, are shown. The tool setup per se (FIG. 18) comprises two half-dies 105 and 106, a vertical punch 107, a first group of three horizontal punches 108 and a second group of three horizontal punches 109. The upper half-die 105 is carried by the piston 103, and the lower half-die 106 is carried by the slidable vertical shaft 110. The lower half-die 106 is shown in further detail in FIGS. 19 and 20; in elevation, the lower half-die 106 comprises a frusto-conical portion 111 joined at its narrowed end to a cylindrical portion 112. The generally flat upper surface 113 has a first array of semi-cylindrical channels designated by the reference numeral 114 and angularly spaced 120° from one another which form with identical channels 114*a* in the lower surface 113*a* in the upper half-die 105 cavities having a diameter equal to that of the three arms 12 of the tripod to be formed and adapted to receive the punches 108. The upper half-die 105 has, in elevation, a shape similar to the lower half-die 106 and comprises a frusto-conical portion 114 joined at its narrow end to a cylindrical portion 116. Three other channels 117 are disposed in the upper surface of the lower half-die 106; these other channels are identical to other channels 117*a* in the surface of the lower die half facing the upper die half 105. These other channels are the continuation of the first array of channels 114 and are adapted to receive the punches 109. The other channels 117 and 117*a* have portions 118 of lesser diameter at their inner ends, the function of which will be described hereinafter. The channels 114 and 118 open at their inner ends into a central cavity 119 of spherical dome-shape corresponding to the spherical dome 16 of the body 11 of the tripod to be formed.

The upper half-die 105 comprises an axial boring or well 120 which has a smaller diameter portion 121 opening on to the surface 113*a* and a truncated conical portion 122 at its opposite end.

The vertical punch 107 which is housed in the well 120–122 of the upper half-die 105 has a shape corresponding to said well: a smaller diameter forming end 123 which sizes the central bore 14 in the tripod and is axially slidable in the straight portion 121 of the well and expands beyond the upper half-die 105, as will be described hereinafter, and the opposite end 124 of truncated conical shape connected to the cylindrical foot 125.

The horizontal punches 108 have at their metal forming ends an axial projection 126 corresponding to the forming and the sizing of the bores 13 at the ends of the arms of the tripods. At the other ends of each of the punches 108 there are tapered conical sections 127 connected to a cylindrical foot 128. The horizontal punches 109 have at their forming ends a projection 129, of a diameter equal to that of the portions 118 of lesser diameter in the channels 117, with a pointed tip 130 for forming the centers 12 in the body of the tripods. At the opposite end of the punches 109, there is a tapered conical section 131 connected to a cylindrical base 132.

The mounting of the half-dies and the punches in their respective supports is described hereinafter.

The vertical punch 107 is secured axially at the free end of the press piston 103 by means of the threaded ring 133. A sleeve 134 is screwed on the upper end of said piston 103 and comprises a lower flange 135 on which the ring 136 rests which also has a flange 137.

A sliding sleeve 138 is slidably mounted on the flange 137 and has at its upper end an inwardly extending flange 139 which freely rests, owing to the force of gravity on the flange 137, on the ring 136. The sliding sleeve 138 is screwed on a circular plate member 140 having a central opening 141 which, too, is circular and receives the rear cylindrical portion 116 of the upper hald-die 105. The end of the cylindrical portion 116 is threaded and threadedly engages the lock ring 142. A Belleville washer 143 is interposed between the lock ring 142 and the bottom of the recess in the top surface of the plate member 140 against which it bears. The Belleville washer 143 in cooperation with the lock ring 142 urges the upper half-die 105 against an annular member 144 which bears against the bottom of a central recess formed in the undersurface of the plate member 140.

The annular member 144 has a frusto-conical inner surface 145 corresponding exactly to the conical surface 115 of the upper hald-die 105.

An annular seating spacer 146 rests on the upper surface of the plate member 140 and is slidably mounted relative to the press piston 103. A compression spring 147 is received about the piston 103 in a space defined between the piston 103 and the sleeve 134 and interposed between the bottom of the sleeve and the annular seating spacer 146. Vertical guiding spacers 148 spaced about the periphery of the base of the sleeve 134 are received in notches in the sides of the plate member 140 for ensuring the centering of the plate member 140 with respect to the press piston and the tool setup.

The lower half-die 106, as mentioned above, is carried by a vertical sliding shaft 110 which has as its upper end a larger diameter portion 110a against which the lower half-die 106 is clamped by means of a threaded rod 150, which passes axially along the entire length of the shaft 110, in cooperation with an annular member 151 identical to annular member 144 against which the upper half-die 105 bears. The shaft 110 is slidably mounted in the sleeve 152 which in turn is slidable in a ring 153 threadedly engaging a tapped hole in plate member 154. A smooth ring 155 also rests on the sleeve 152 and acts as a spacer member, as will be discussed below.

The plate member 154 is secured to the table 104 of the press; a flat ring 156 carrying a downward extending skirt 157 is secured on the press-table 104.

The lower end of the shaft 110 rests on a cylindrical spindle 165 which is extended downwardly by a sleeve 166 which tops the upper end of a vertical shaft 167 which is fixed to the sleeve 166 by a pin 168. The sleeve 166 forms, relative to the spindle 165, a shoulder 169 on which rests the inwardly extending flange 170 of a sleeve 171 having a flange 172 at its lower end. The lower end of a compression spring 173 bears against the outwardly extending flange 172. The upper end of the compression spring is urged against the underside of the annular member 174 which is guided in the skirt 157 and is in abutment against the underside of the ring 153. The sleeve 152 which slides on the shaft 110 also rests on the annular member 174. The sleeve 166 is slidably mounted on a cylindrical bush 175 mounted in a plate 176 which is welded on the upper ends of a pair of brackets 177, one at each side of the section line in FIG. 17, which are maintained parallel by transverse tie rods 178 passing through uprights 100 of the press and fixed by nuts 179. Tubular bracing members 180, 181 are received on the tie rods for maintaining the brackets 177 in their desired positions. A plate 182, similar to the plate 176, is welded to the underside of the brackets 177; a cylindrical bush 183 in which the shaft 167 slides, is mounted in the plate 182.

A mounting collar or rocking lever 184 is fixed to the shaft 167 underneath the sleeve 166 and has a yoke to each side of the shaft 167, including one yoke in which a first link 187 pivots on a pin 186. A second link 189 is pivotally mounted on a spindle 190 extending between two lateral plates 191 which are each fixed along one of their vertical sides to a sleeve 192 on a tie rod 193 and retained thereon by a nut 202. Each pair of links 187 and 189 forms a yoke for mounting a roller 194 for rotation about their common pivot pin 188 and rolling displacement along a part-circular cam member 195 which is held between the corresponding pair of brackets 177 by a threaded rod 196 with shims 197 and 198 between the brackets 177 and the cam member 195. The radius of curvature of the cam surface and the mounting of the cam member are such that the center of curvature is substantially along the axis of the pivot pin 186 when the press is in its raised or open position shown in FIG. 15.

The four tie rods 193 each having a tubular bracing member 199 received thereon connect the lower "bridge" formed by the lateral plates 191 with transverse spindles 190 to the upper "bridge" comprising two similar lateral plates 200 which are each fixed along one of their vertical sides to a sleeve 201 received and clamped on the tie rods against the tubular bracing members 199 by nuts 202, the lateral plates 200 being connected to each other by sections 203. The upper bridge thus made up is carried by an annular member 204 retained toward the top of the sleeve 134 on the press piston 103, with the cooperation of rings and circlips 205 on a ring member 206 having a lower toroidal surface which cooperates with the upper surface of corresponding shape on a ring member 207 for forming a ball-and-socket joint, the ring member 207 carried on an annular member 208 being freely slidably mounted on the sleeve 134 and supported on the ring 136.

The horizontal punches 108 and 109 are mounted in the same way, each being secured by means of a screw 209 on a vertical ram 210, formed as a rectangular plate (see FIGS. 18 and 21) mounted in a guide-slot 211 in an oblique ram or block 212, which is of the same type as the blocks 32 in FIG. 11, to the extent that each oblique ram 212 is T-shaped in cross-section providing two lateral ribs 213 (FIGS. 21 and 22) making an angle $\alpha = 12°$ with the slot 211. The body of each ram 212 and its ribs 213 are received in the T-shaped slot of a member 214, which is identical to the slotted members 35 in the tool set-up of FIG. 11, the front face of which has the same slope $\alpha$ relative to the vertical as the lateral ribs of the corresponding ram 212. The six slotted members 211 correspond to the six rams (three for the punches 108 and three for the punches 109), are hooped by a cylindrical member 215 and held, as is the cylindrical member 215, between the lower plate member 154, as previously mentioned, and an upper plate member 216, the two plate members being urged toward each other by the tie rods 217 and associated bracing-members or cross-members similar to those in FIGS. 11 and 12 being provided, if necessary, for maintaining the desired angular spacing between the slotted member 214 each of which may, however, have a 60° opening relative to a point located on the vertical axis of the press in case the spacers are not required.

The slotted member 211 for each oblique ram 212 is open along its forward face for forming a corridor 217 for the passage of the base or foot 128 or 132 of the punch mounted on the vertical ram 210 with which it cooperates. Each ram or block 212 also has at its base two projecting portions 220 adapted to come to rest at the end of the press stroke on the smooth ring 155 mounted on the vertical shaft 110.

The device which has just been described operates as follows:

When the press is opened, i.e., in the raised position shown in FIG. 15, an intermediate tripod workpiece, obtained as described hereinabove and shown in FIG. 10, is placed in the lower half-die 106. In this position, the rams 212 are at their uppermost positon and the horizontal punches 108 and 109 are simply in engagement with the closed ends of their respective channels 114 and 117 in the lower half-die 106, leaving a space free for introducing the workpiece.

The press piston 103 is then lowered which in turn brings the bottom of the upper half-die 105 in contact with the lower half-die 106. The combination forming the so-called upper bridge 200–203 which is suspended from the sleeve 134 fixed to the piston 103, the tie rods 193 and the so-called lower bridge 191–192 also moves downwards with the piston 103 which causes the transverse spindles 190 and the links 189 to be pulled downwards. The linkage formed by the links 189 and 187 progressively opens; however, as long as the rollers 194 rest against the part-circular cam surface of the members 195, the pivot pins 186 and therefore the mounting collar 184 and the vertical shaft 167 with which it moves and the spindle 165 fixed by the sleeve 166 on the shaft 167, remain stationary, as well as the shaft 110 and the lower half-die 105 comes in contact with the lower half-die 106 and closes the die.

As the piston 103 continues its downward movement and as the rollers 195 rest against the part-circular cam surface of the members 195, the die 105–106 remains stationary and the springs 147 is gradually compressed, and the punch 107 moves downwards toward the upper half-die 105. Under the force exerted by the piston 103, the punch 107 enters the central bore 14 of the tripod workpiece which is between the two dies for finishing of the bore 14 and extruding or driving back the metal for forming, in the spherical cavity 119 of the lower half-die 106, the spherical dome 16 of the tripod body 11.

The finishing and forming operations of the bore 14 and the spherical dome 16 stop when the plate member 140 abuts against the flange 135 of the sleeve 134 which is fixed on the press piston 103; as said piston tends the move downwards, it compresses the upper half-die 105 against the stationary lower half-die 106 by means of the sleeve 134, the plate member 140 and the annular member 144.

This phase of the operation continues until the rollers 194 reach the vertical portion on the cam surfaces which corresponds to the moment when the two half-dies 105 and 106 are preloaded at a predetermined force. At this moment, the links 187 and 189 are practically in alignment and the lower bridge pulls downwardly by means of the links, the mounting collar 184, the shaft 167 and the spindle 165 which, when it retracts, leaves the sliding shaft 110 free to descend with the closed and preloaded half-dies. The half-dies bring with them the punches 108 and 109 while the vertical rams which support the punches 108 and 109 move downwardly in the guide-slots 211 of the oblique rams 212; this movement continues until the enlarged head 110a of the vertical shaft 110 comes into abutment against smooth ring 155. From this moment on, and for the reason that the links 187 and 189 are fully opened and in vertical alignment with each other, a closed rigid loop is formed, comprising the two half-dies 105 and 106, the sliding shaft 110, the spindle 165, the shaft 167, the links 187 and 189, the lower bridge 191, the tie rods 193, the upper bridge 200–203, the annular and ring members 204, 206, 207 208, the ring 136, the sleeve 134 and the press piston 103. This closed rigid loop ensures, independently of the operation of the press, the squeezing of the two half-dies against each other without the force initially exerted by the piston which may reach 100–200 metric tons. The half-dies are thus held closed without subsequently reducing the actual capacity of the press which therefore can be used in its totality for forming.

Thus, the piston 103 continues its downward movement; the circular plate member 140 abuts against the upper face of the oblique rams 212 which begin their downward movement along the slotted members 214 moving toward the vertical axis of the press and bringing with them the punches 108 and 109. It should be noted that at this moment the vertical rams 210 carrying their punches have reached the end of their travel with respect to the oblique rams, and since the two half-dies between which the punches are held move downwards with the piston 103 owing to the presence of the closed rigid loop described above, there is no further relative movement between the rams 210 and 212. The rams 212 resting against the ring 155 also drive downwardly therewith the sleeve 152 and the annular member 174 which compresses the spring 173.

Since the annular plate member 140 is in contact with the sleeve 134, the piston 103 then ensures by itself the rest of the downward movement of the rams 212 through the elements 140 and 134, and therefore the penetration of the horizontal punches 108 and 109 into their associated openings in the half-dies. The punches 108 size the arms 12 of the tripod to their exact desired length and form the bores 13 in the ends of the arms of the tripod arms, and the punches 109 form the centers 19. The position of the tool setup at the end of the stroke is clearly shown in FIG. 18.

Figure 15:
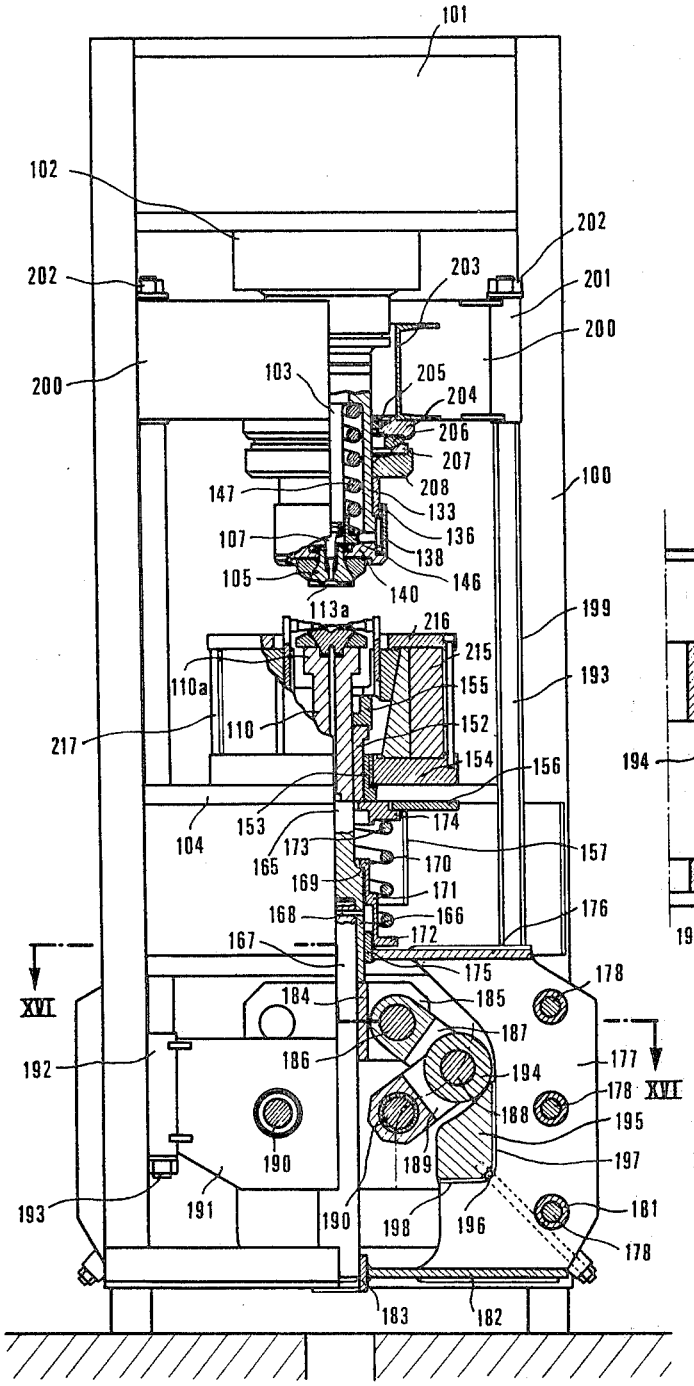
FIG. 15 is a view partly in elevation and partly in vertical section of a press with a setup for finishing the piece of FIG. 6 and 7, the press being shown in its raised position before introducing an intermediate workpiece to be finished.
Figure 17:
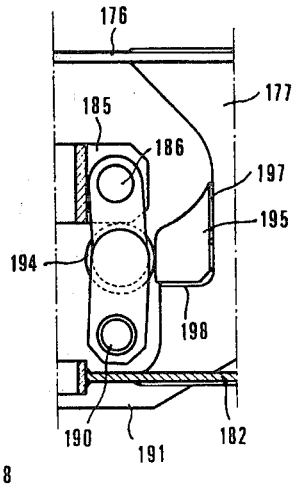
FIG. 17 is a detail showing the linkage supporting the lower part of the die in the press tooled up according to FIG. 15 in the extended position of the linkage.
Figure 18:
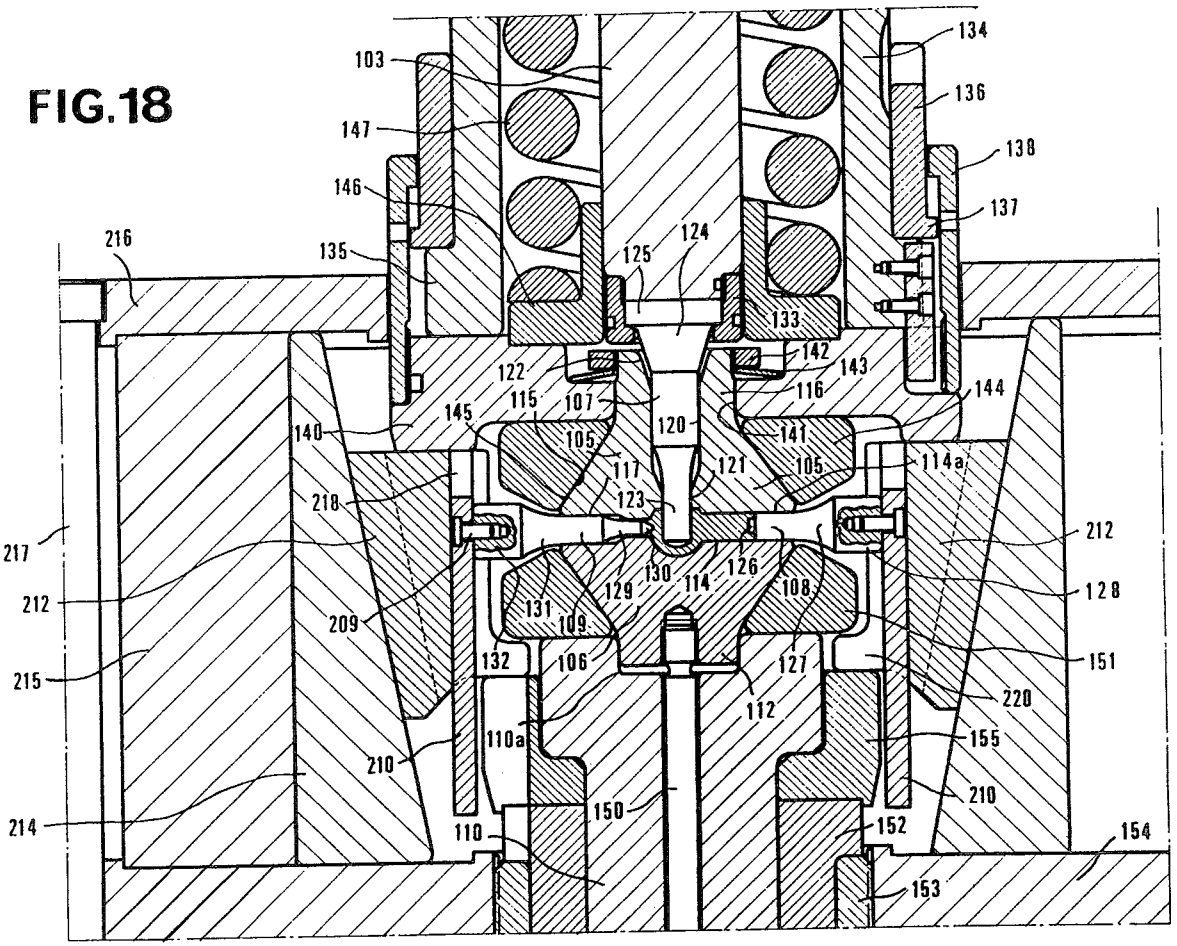
FIG. 18 is a view, on a larger scale, of the tooled-up press shown in FIG. 15.

The press piston is then raised and the other members, parts and elements of the device return to their positions as shown in FIG. 15, the spring 173 effecting the return movement of the rams 212 and therefore their moving apart from one another and the moving apart of the punches 108, 109. The finished tripod can then be removed.

It should be noted that the closed rigid force loop binding system of the force on the press in combination with the system of toggle joints controlled by cams gives a cooperation of difference sequences with very great precision and accuracy of movements, this permitting mass production under particularly economical and rapid conditions.

The value of the force for closing the half-dies is easily adjusted by the nuts 202 and the length of the bracing members 199.

The shape of the cam surfaces shown in the drawings could conceivably be varied in their radial or vertical dimensions as a function of the part to be formed.

It is also possible to replace the function of the cam 195 and the roller 194 with a jack adapted to exert a force at the common pin of the toggle joint and controlled electrically at the precise moment while preserving the advantage of the half-dies closure sequence in the down stroke of the press and the advantage of the closed force looping for closing the die which does not reduce the force available for effecting the forming work per se.

The force looping system may also be effected in such a way that the force exerted along the axis of the press on the tripod to be finished, by means of the laterally operating punches, is at every moment proportional to the force of penetration of the punches into the workpiece.

Such an embodiment is described hereinafter with reference to FIGS. 23 and 24 which, for the sake of simplification, only show the basic elements of the tool setup.

The machining which is to be carried out in the illustrated embodiment is the cutting of longitudinal grooves 225 in the surface of a sliding hub 226. The longitudinal grooves 225 are part-cylindrical (FIG. 24) in cross-section and have part-spherical end portions (FIG. 23). The longitudinal grooves 225 are intended to receive ball bearings for reducing friction during rotation as well as axial displacement of the hub 226 in a journal. The hub comprises two shoulders 227 and 228 one to each side of the central portion in which the twelve longitudinal grooves 225, which are grouped in six pairs of aligned grooves, are to be formed.

The tool setup essentially comprises six punches 229 each having a pair of teeth 230 corresponding to a pair of aligned grooves 225. The punches 229 are held in oblique rams 231, similar to the rams 212 in FIG. 15, and slidable in slotted members 232, similar to the slotted members 214 in FIG. 18, which are clamped together by an annular hooping member (not shown).

A drive member 233 is mounted on the press piston (not shown) and comes into contact against the shoulder 227 of the hub to be formed. The hub in turn transmits the force through its lower shoulder 228 to a lower drive member 234 which bears against an annular member to which it is fastened by screws 236. The annular member 235 is connected by tie bolts 237 to an upper plate member 238 which in turn bears against the top of the rams 231 (at the left-hand side of FIG. 23 a punch 229 is shown very schematically). When the press piston is actuated, the hub being previously positioned on the lower member 234 and the drive member 233 formed in two parts and being engaged with the upper part, the descent of the drive member 233 brings about through the workpiece itself, the lower annular member 235, tie bolts 237 and the upper plate-member 238, the descent of the rams 231 and therefore the penetration of the teeth 230 of the punches 229 into the hub to be machined. Axial creep of the metal of the hub is avoided during the operation of the punches since the hub is compressed vertically by a force proportional to the radial force of penetration of the six punches. If the axial retaining force applied against the workpiece were not proportional to the radial forming forces, the grooves thus formed would be axially deformed by an undersirable lengthening of extrusion and their profiles would be altered making the resulting part unsuitable for the intended use. Indeed, this workpiece cannot be ground after cold forming or heat treatment and the forming according to the invention must therefore provide the precision necessary for correct rolling and sliding of ball bearings without subsequent modification.

Further, the inevitable variations in the hardness of the starting metal does not modify the quality of the grooves formed.

A second advantage of the rigid closed looping system is to produce an axial force in the range of 100 metric tons or more in a simple manner by avoiding spring systems which take up a great amount of space and are prohibitive in cost, without increasing the force necessary for the operation of the press. In other words, if a 120 MT press is employed for example, it is possible to exert a clamping force of 150 MT while preserving the total capacity of the press, i.e., 120 MT for the radial forming of the workpiece.

In case the surfaces bearing against the shoulders 227 and 228 are inadequate for exerting an efficient axial force, other bearing surfaces could be provided at the ends of the hub which would enable the advantageous provision without cost of center points useful in assembling the hub in a transmission tube.

Figure 25:
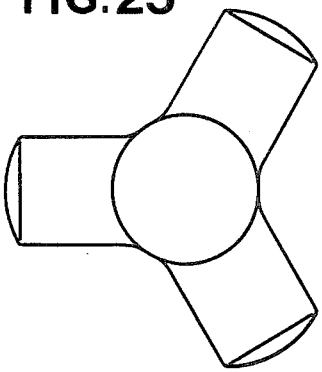
FIG. 25 is a front elevation view of another kind of part which could be formed according to the invention.
Figure 26:
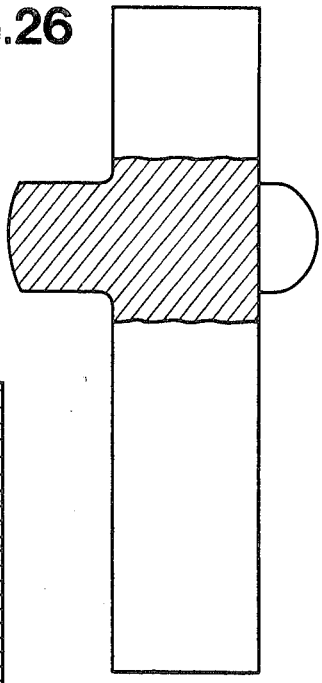
FIG. 26 is side elevation view with a portion in cross-section taken on the line XXVI—XXVI in FIG. 25.

FIGS. 25 and 26 show another variety of parts of the tripod family which may be obtained with the device according to the invention. In this part, the portions extending radially of and perpendicular to the main axis are received in a shaft of variable length, the machining of the part is carried out by means of a device similar to that of FIGS. 11 and 12.

The starting piece is also a cylindrical billet, but longer than the one employed for the tripod of FIGS. 6 and 7. This type of part may be necessary when the tripod is to be connected to a tube, for example, by a groove system. The radial projection may also be located at the end of the bar.

Figure 29:
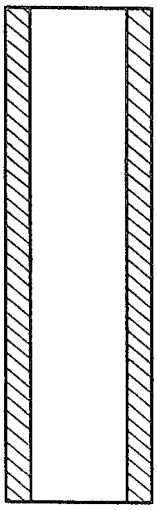
FIG. 29 is a longitudinal cross-sectional view of the starting billet used to obtain the tripod of FIGS. 28 and 29.
Figure 27:
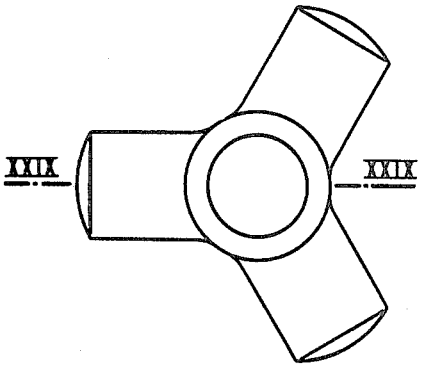
FIGS. 27 and 28 are views similar to those of FIG. 24 and 25 for an alternative type of tripod which can be made according to the invention.
Figure 28:
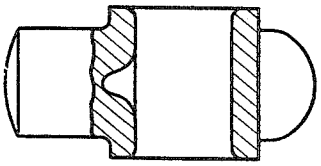

FIGS. 27 and 28 show another variety of tripod in which a cylindrical central bore goes straight through the part. The starting billet is tubular in this case and is shown in FIG. 29. During the machining operation effected on a setup identical to that of FIGS. 11 and 12, a filler-block or antifriction lining is inserted inside the tubular billet preventing local internal buckling. This lining is removed while the punches are fed into the cylindrical recesses provided therefor.

This antifriction lining may advantageously be replaced by a ring of incompressible elastromeric material which fills all or part of the cavity in the billet and accompanies the deformation of the extruded billet while aiding this deformation, owing to the high hydrostatic pressure exerted on this ring during the deformation of the billet. This is intended to prevent local internal buckling of the billet and favor extrusion in the ONS radial direction.

The central bore in the tripod which is shown as passing straight through the tripod may also be a blind bore with the provision of an incompressible lining, appears to be indispensable for a proper extrusion resulting in a sound part. It is realized that the central bore and, if need be, the starts of radial cavities or bores obtained by extrusion must naturally be compatible with the use of such a part or with the subsequent shaping operations when they are necessary. After extrusion, the lining may be removed, or left in place and considered waste material.

The lining could be formed of various deformable incompressible materials or even a suitable liquid.

Figure 30:
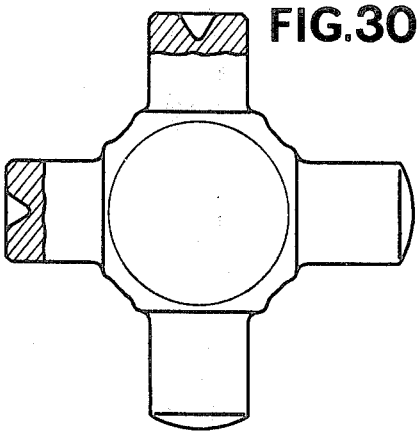
FIG. 30 is an elevation view with cutaway portions of a four-arm cross-piece of a universal joint which can be made according to the invention.

FIG. 30 shows a cross-piece for a univeral joint which may be obtained according to the invention, comprising four radially projecting portions extending perpendicular to the main axis which is known as a cross-piece when used in universal joints. The starting billet in this case is similar to that shown in FIG. 9.

Figure 12:
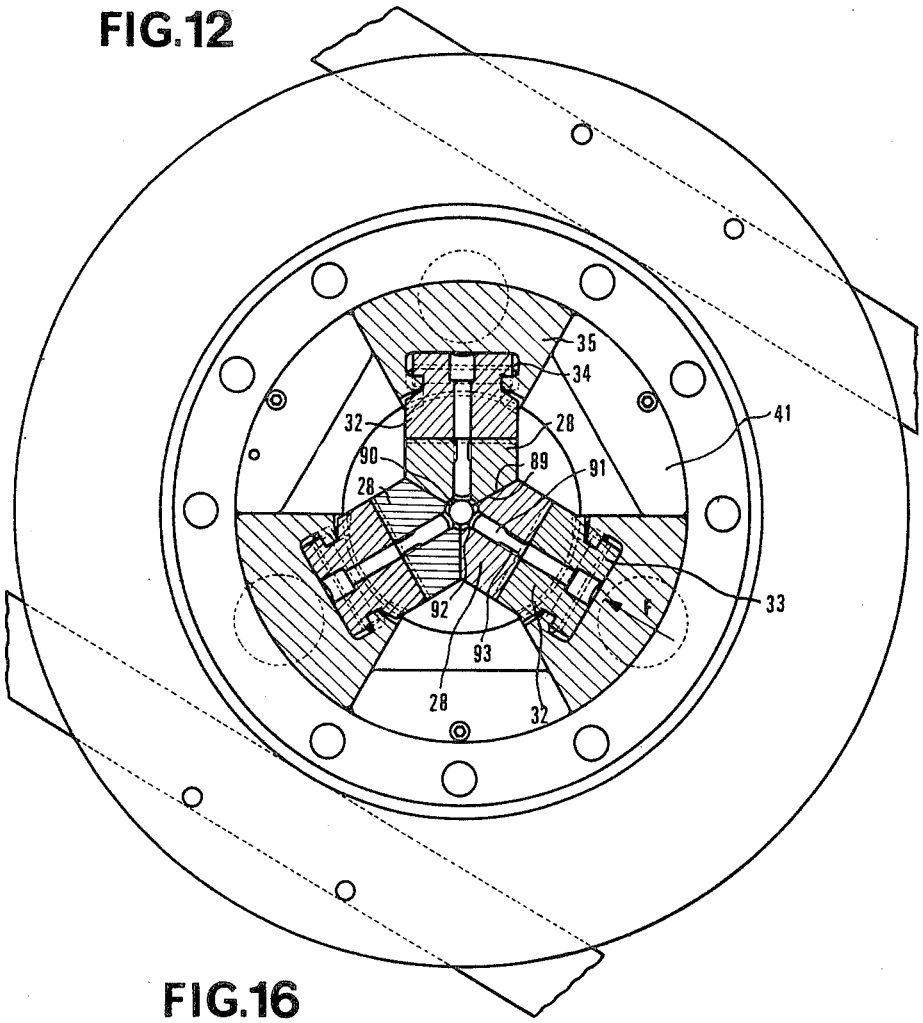
FIG. 12 is a cross-sectional view taken on the line XII—XII in FIG. 11.
Figure 16:
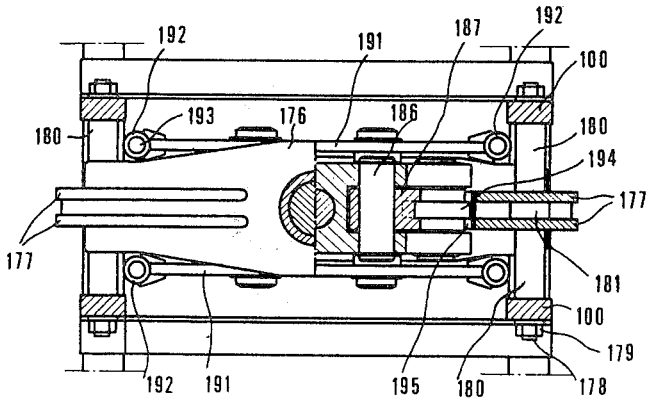
FIG. 16 is a cross-sectional view taken on the line XVI—XVI in FIG. 15.
Figure 20:
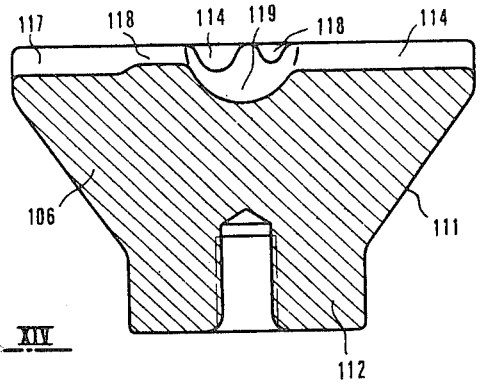
FIG. 20 is a cross-sectional view taken on the line XX—XX in FIG. 19.
Figure 13:
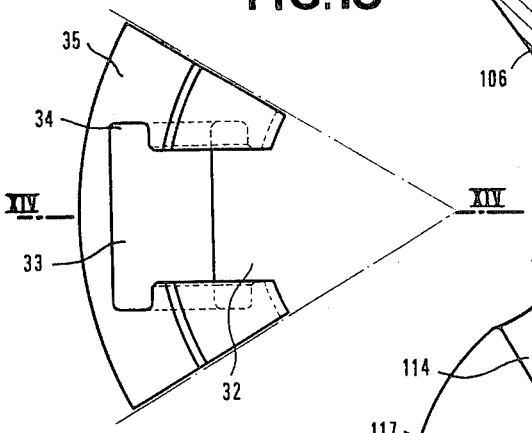
FIG. 13 is a plan view of a guide-rod which is part of the tool setup for the press shown in FIGS. 11 and 12.
Figure 19:
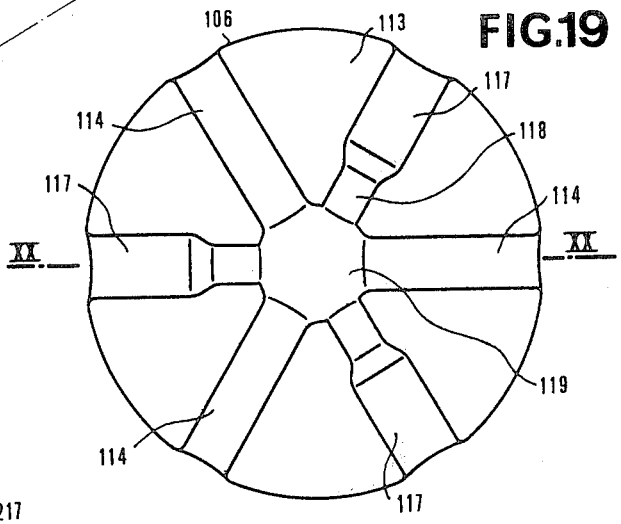
FIG. 19 is a plan view of the lower part of the die of the tooled-up press of FIG. 15.
Figure 22:
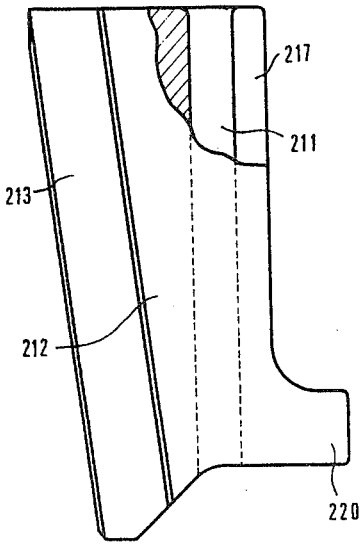
FIG. 22 is a cross sectional view taken on line XXII—XXII in FIG. 21.
Figure 21:
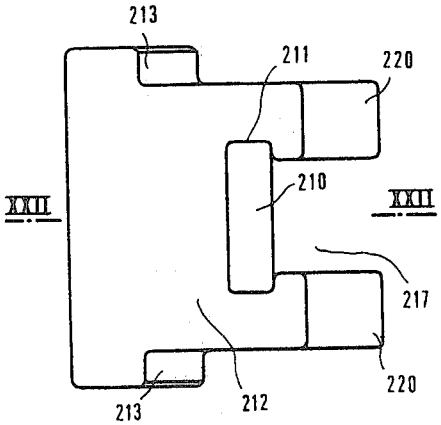
FIG. 21 is a plan view of a block which is part of the tooled-up press in FIG. 15.

This type of cross-piece is always obtained on the setup shown in FIGS. 11 and 12 for the intermediary workpiece. The finishing of the cross-piece may be carried out on a setup such as shown in FIGS. 15–20 using the identical principles.

The above embodiments and examples are given by way of example. It is recognized that numerous other parts having a main axis and plurality of projecting portions distributed radially thereabout may be treated according to the method and by the means of the present invention.

According to another aspect of the invention there are provided radiating cavity portions or grooves adapted to form the lateral arms, each one in part in the face in contact with one die sector and in part in the face of an adjacent die sector, each of the parts of such a radiating cavity or groove opening, without any undercutting or counterdraw onto the face in which it is disposed.

Thus, the junction plane of contact of adjacent sectors, in the most common case, in which each arm of the part to be provided is a body of revolution or at least symmetrical with respect to a diametral plane, coincides with a diametral plane.

The stripping of the part may then proceed by relative movement of the sectors which back off laterally and not as before, longitudinally. Consequently the amount of the movement is greatly reduced. Furthermore, it becomes possible to produce parts with arms having shapes other than a plain cylinder. Lastly, it was surprisingly discovered that the probability of metal losses at the junction between adjacent die sectors was practically null.

Figure 31:
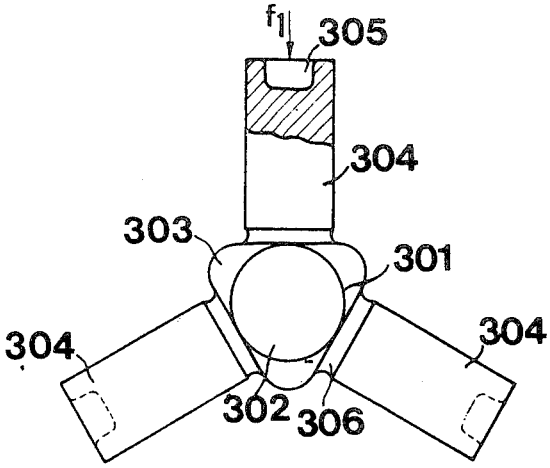
FIG. 31 is a front elevation view of another kind of part which could be cold-formed with an alternative die shown in the following figures 33 to 38.
Figure 32:
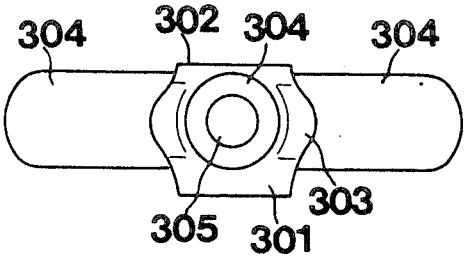
FIG. 32 is a side elevation view of such a part shown in FIG. 31 in the direction of the arrow $f_1$.
Figure 33:
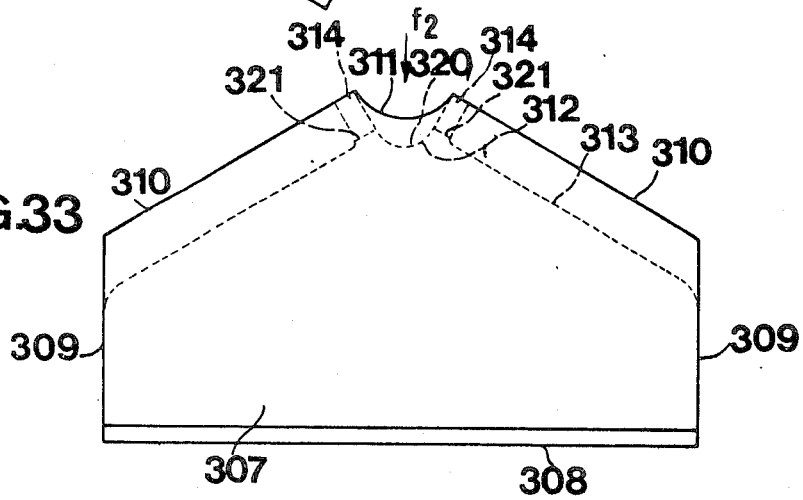
FIG. 33 is a plan view of one sector of a die for forming parts shown in FIGS. 31–32.
Figure 34:
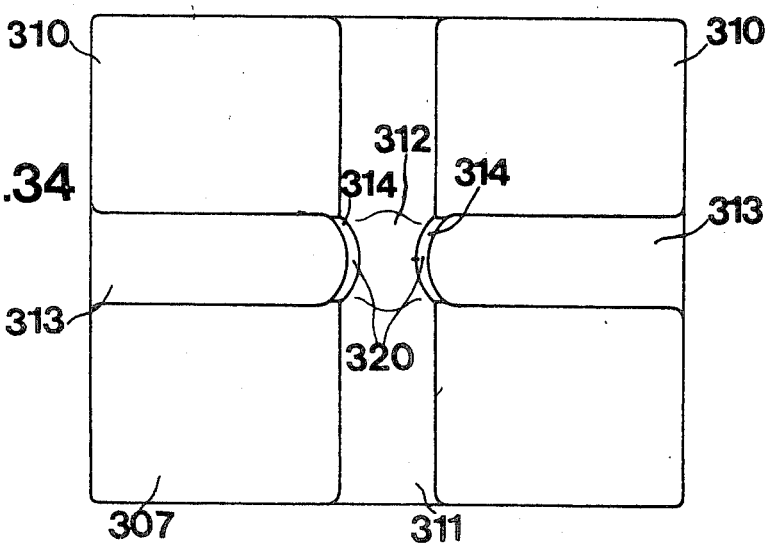
FIG. 34 is a front elevation view of this die in the direction of the arrow $f_2$ of FIG. 33.
Figure 35:
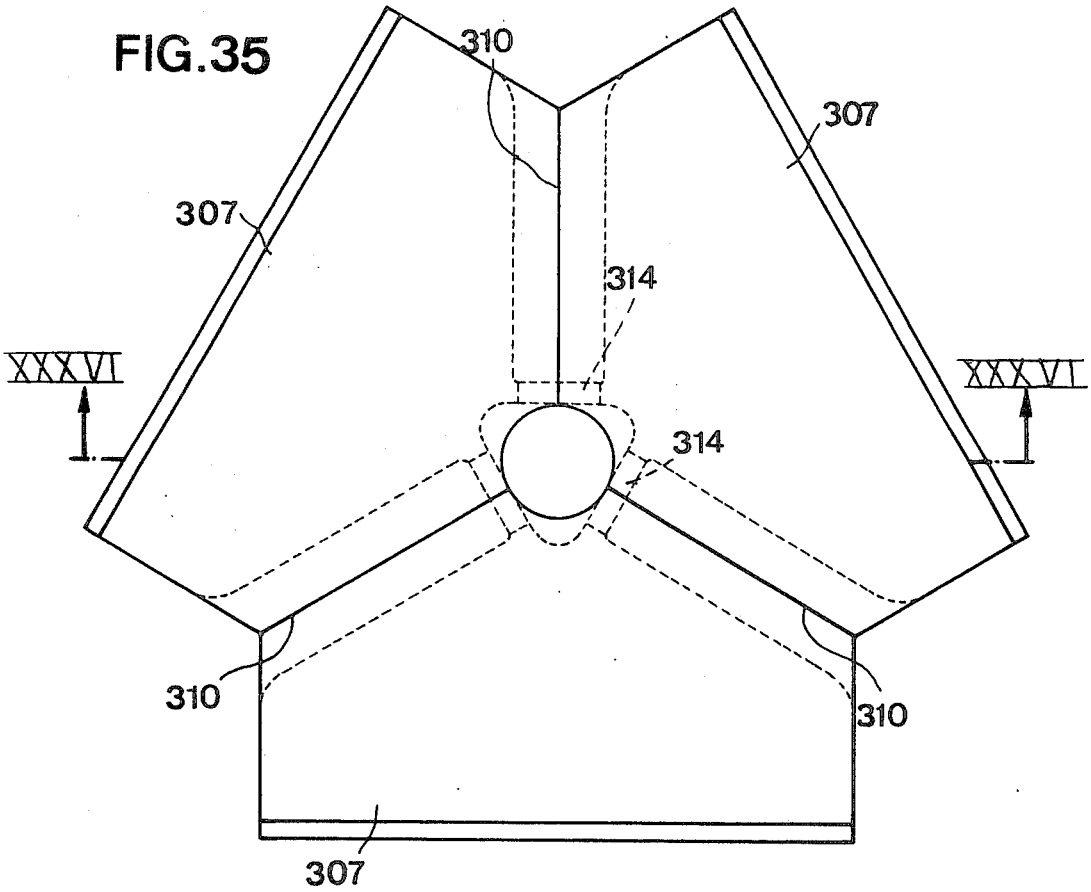
FIG. 35 is a plan view of the die formed by three sectors of FIGS. 33 and 34, said sectors being in contact all together.
Figure 36:
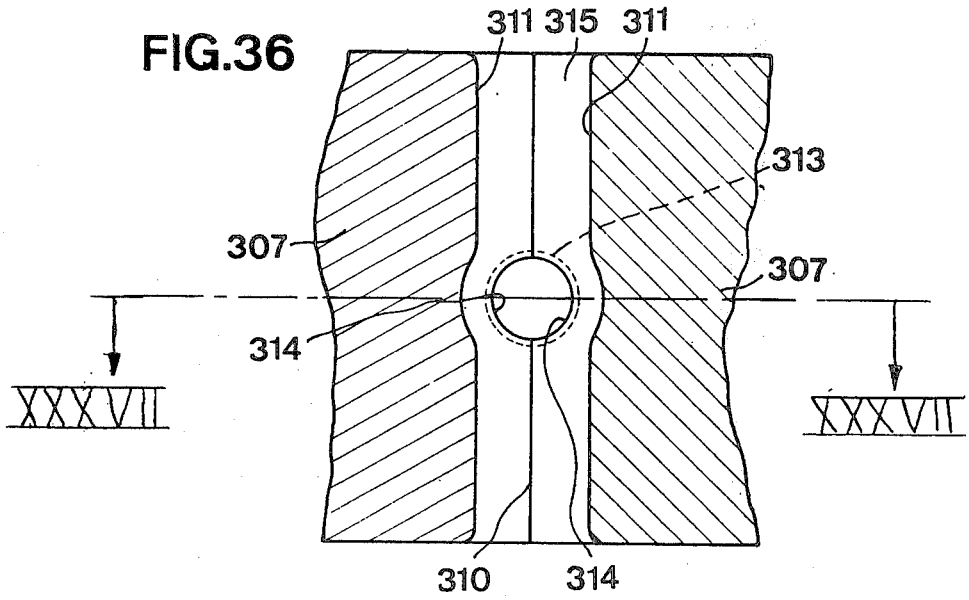
FIG. 36 is a cross-sectional view taken on the line XXXVI—XXXVI of FIG. 35.

As shown in FIGS. 31 and 32, the part to be produced is an element of a constant velocity universal joint known as the so-called tripod or three-arm-member, comprising a central body 301 with two planar faces 302 and central bulges 303 giving a triangular shape to the central body 301 with small faces from which the three cylindrical radial arms 304 extend each having at its free end a blind hole 305 and each joined to the central body 301 by a portion of smaller diameter 306.

The die for producing such a part comprises three steel sectors 307 (FIGS. 33 through 38). Each of the sectors (FIGS. 33 and 34) is of generally pentagonal shape (in plan view) and has a rear face 308 arranged to be driven by a slide or ram (not shown) as described above, two lateral faces 309 perpendicular to the rear face 308 and two front faces 310 carefully faced and perfectly flat overall, each front face 310 making an angle of 60° with the plane of symmetry bisecting the rear face 308. In the region of the theoretical dihedral angle formed by the intersection of the front faces 301, each sector 307 is hollowed out or recessed as a part-cylindrical surface 311 whose radius is equal to that of the planar faces 302 of the central body 301 of the resultant part. Halfway along the height of the sector the part-cylindrical groove is deepened at 312 so as to correspond to the shape of the bulges 303 of the central body 301 of the resultant part. At the same height up the sector there is a semi-cylindrical groove 313 along each of the front faces 310 which terminates in the part-cylindrical groove 311, or more precisely the deepened portion 312 thereof, by means of a throat 314 which is also semi-cylindrical and forms half the extrusion orifice as will be seen hereinafter; the radius of this semi-cylindrical throat 314 is equal to that of the narrowed or necked portion 306 of each arm 304 of the part.

In order to produce the part, the three die sectors 307 are brought together (FIGS. 35 through 37) and in contact along their front faces 310 and then locked in this position as described in detail here above. The three part-cylindrical surfaces 311 define in combination the cylindrical cavity 312 with a central bulge corresponding to the deepened portion 312, and the throats 314 of the grooves 313 in pairs of adjacent sectors 307 forming circular extrusion dies which are extended by slightly larger cylindrical cavities formed by the meeting of the corresponding grooves 313, the grooves or radiating cavity portions having a diameter which is equal to that of the arms 313 of the resultant part.

A cylindrical billet 316 previously introduced between the sectors of the die in the cylindrical cavity (see sector XOY in FIG. 37) is of substantially the same diameter as the cylindrical cavity, and once the die is locked in position as mentioned above, the vertical compression can get under way by means of two (vertical) punches (not shown), one fixed for movement with the plate of the press and the other with the piston of the press. The punches enter the perspective ends of the cylindrical cavity 315 as described above. In response to the compressive force the billet 316 deforms so as to fill the cylindrical cavity 315 and its bulges 312, and part of the billet material passes through the extrusion dies defined by the throats 314 to extrude roughed arms 304*a* (see sector XOZ in FIG. 37). Tools 317 arranged to simultaneously enter the cylindrical bores defined by the pairs of cooperating grooves 313 are then driven therethrough, for example, by means of slide and guide assemblies comparable to those effecting the displacement of the die sectors and wedged between control or drive assemblies thereof. Each of the tools 317 has a cylindrical portion 318 of the same diameter as the radiating cavity portions of grooves 313 and a terminal protuberance 318 corresponding to the blind hole 305 to be formed in the free end of each arm 304 of the resultant part. The tools 317 drive back the billet material of the rough arms 304*a* which completely fills each of the grooves 313, the protuberance 319 at the free end of each tool 317 forming the corresponding hole 305 (see sector YOZ in FIG. 37).

Figure 38:
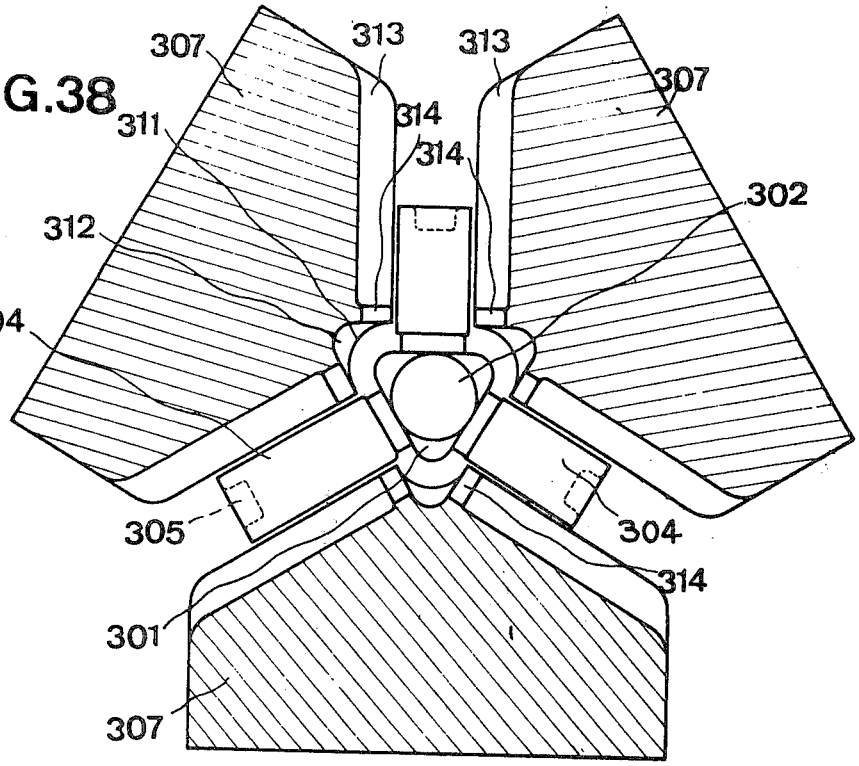
FIG. 38 is a view similar to the view of FIG. 37 but showing the sectors apart for the stripping of the cold-formed part.
Figure 37:
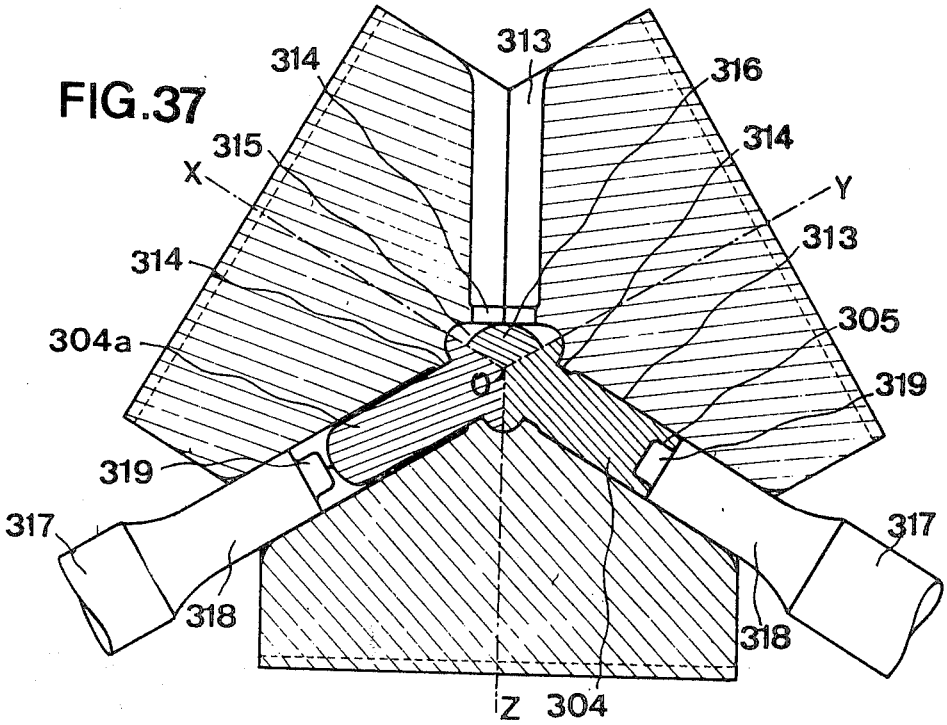
FIG. 37 is a horizontal sectional view of said die taken on the line XXXVII—XXXVII of FIG. 36 showing the part being formed at three stages and parts of the tool setup co-acting with said die.

The return movements are then effected, withdrawing the tools 317 and the vertical punches, then separating the sectors 307 of the die; the part thus formed can then be removed (FIG. 38).

It has been found that in the die according to the invention each of the extrusion orifices 314 is defined by pairs of adjacent sectors 307, the common junction planes defined by the front faces 310 of the die sectors pass along the axes of the extrusion orifice and the grooves 313.

This technique confers on the die sectors stress and wear resistance which is very much greater than for dies in which the junction planes are disposed between the extrusion orifices and the radial grooves which continue beyond the orifices, each extrusion orifice and radial groove or bore being in such circumstance formed in a single unit in only one sector.

In fact, the regions of the common junction planes of the extrusion orifices are subject to only slight pressure in the case of radial extrusion, whereas the high pressures are concentrated in the regions 320 (FIG. 33) which have no structural discontinuities. Furthermore, the elimination of the junction plane in the high pressure zones also eliminates burrs in the junction plane and therefore does not slow the plastic flow of the metal billet, it eliminates the abrasion of the die sectors and excess of pressure on the edges.

Moveover, the machining of die sectors and the checking or quality control of the extrusion orifices are greatly simplified since all the forming surfaces of each sector is in relief, visible and readily accessible. Low cost and precision methods for producing the forming surfaces, such as electroerosion or stamp finishing, may be easily employed. The production cost of the die sectors is therefore reduced. Further, the die sectors may be reconditioned after significant wear by grinding the bearing surface planes, the throats and the forming surfaces because the stepped portion 321 (FIG. 33) which wears in the extrusion orifice is located at right angles to the junction planes. Such advantages may greatly extend the service life of the die sectors and thereby reduce production costs.

The stroke of the die sectors required for stripping the formed part in much less than the length of the arms and demands very little work. This results in the simplification and the possibility of lightening the operating mechanism and an acceleration of the forming operation of each part.

It is noted furthermore that it is possible to manufacture parts whose radiating arms are of variable diameter, increasing toward the central body (respective parts 306 and 304) which would obviously be impossible if the part had to be stripped by extraction from a bore in one action.

Figure 39:
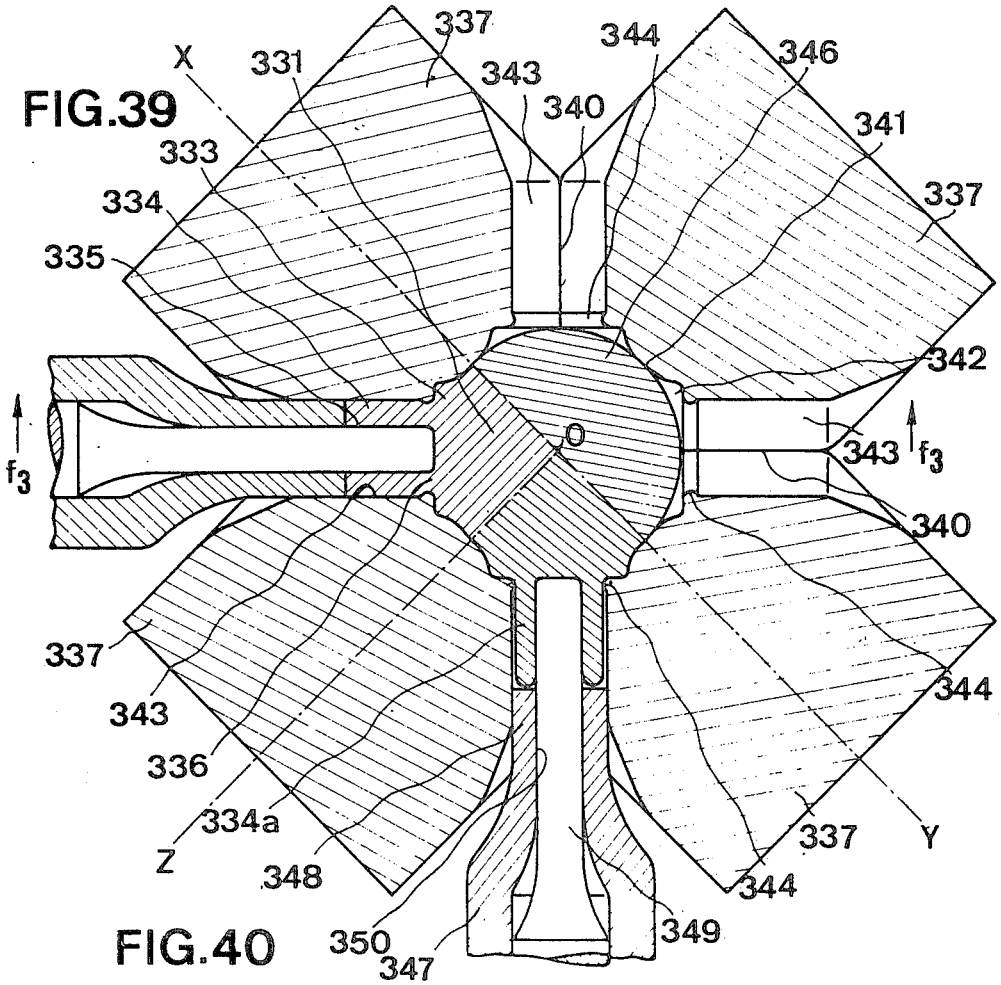
FIG. 39 is a view similar to the view of FIG. 37 of another die having four sectors and used for cold-forming a part the shape of which differs from the shape of the part shown in FIGS. 31 and 32.
Figure 40:
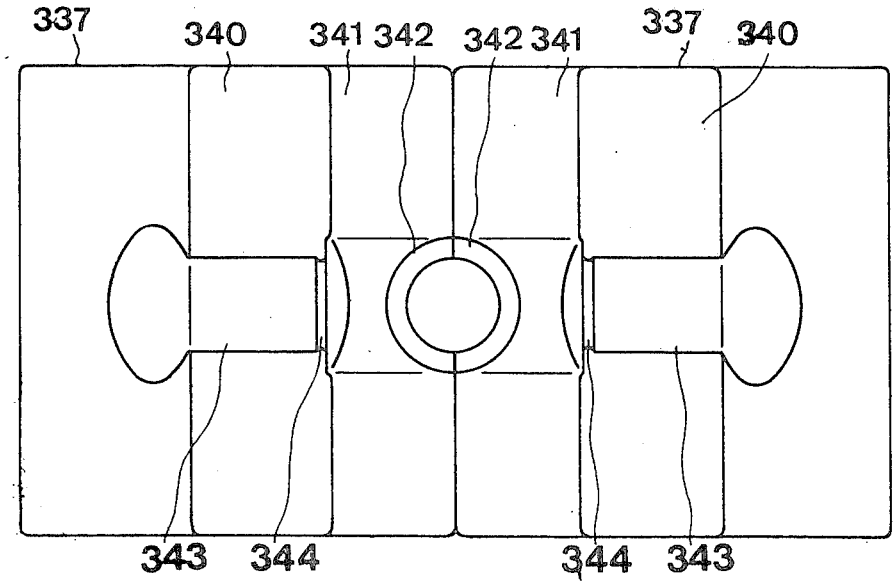
FIG. 40 is a front elevation view of two sectors of the die shown in FIG. 39, in the direction of arrow $f_3$ of said figure.

FIGS. 39 and 40 illustrate a die adapted for cold forming a part having four axially hollowed arms such as a universal joint cross piece or spider. The final shape of the part is shown in sector XOZ of FIG. 39; this part comprises a central body 331 with bosses 333 from which the four arms 334 protrude, the arms 334 being axially hollowed at 335 and joined to the bosses 333 by a narrow diameter portion 336.

The die comprises four sectors 337 similar to sectors 307 of FIGS. 33 through 38, in that they are in contact with one another along front faces 340 in which grooves 343 each with a throat 344 are formed, the throats defining an extrusion orifice through which the material which makes up each roughed arm 334*a* is formed and in which each roughed arm is accommodated to get its final shape. The grooves 343 open into semi-circular recesses at each side of the central zone of a quarter cylindrical hollow 341 provided at the location of the dihedral angle defined between the two faces 340 of each die sector 337.

As in the previous embodiment, the starting element is a billet 346 which is placed in the cylindrical cavity defined by the four recesses 341 (see the upper right half XOY in FIG. 39). The billet is compressed vertically from above and below and fills the internal cavity of the die thereby forming by extrusion roughed arms 334a (see sector YOZ in FIG. 39). The finishing tools in this embodiment comprise each in two parts, viz., a first hollow body 347 terminating in a cylindrical nozing 348 with an outer diameter equal to that of the corresponding groove 343, the hollow body 347 also having an axial bore 350 whose inner diameter is equal to that of the bores 335 in the arms 334 of the resultant part, and a drive pin 349 which is received in the axial bore 350 of the nozing 348 and has a diameter equal to that of the bores 335. Before the compression of the billet, the drive pins 349 of each finishing tool is inserted into the corresponding groove 343, the centering of the drive pin in the groove being ensured by the simultaneous reception of the nozing 348 of the hollow body 347 in the entrance to the same groove. Thus, during the compression of the billet 346 the metal extruded through the extrusion orifice 344 flows around the drive pins 349 which define the bores 335 in the roughed arms 334*a* (sector YOZ in FIG. 39). The nozing 348 of the hollow body 347 is then pushed inside the groove 343 for driving back the material of the roughed arm 334*a* which then fills the entire groove 343 (see sector XOZ in FIG. 39), to take on the final shape of the arm 334.

The stripping of the formed part is accomplished as in the previous embodiment by withdrawing the tools 347 and 349 while radially moving the die sectors apart, similar to the showing in FIG. 38.

The above-described dies are only preferred embodiments; numerous structural modifications may be admitted without going beyond the scope of the invention.

I claim:

1. A setup for a press including a piston and a table for cold-forming metal parts of the type having a central body and generally radially extending projecting portions extending outwardly from the central body starting with substantially cylindrical metal billets, said setup comprising a first assembly including a plurality of die-sectors arranged for being brought radially together and coupled along adjacent faces to form a die, said die having a central chamber cavity extending entirely through it and having a shape corresponding to the shape of the central body of the part to be formed and extensions permitting the insertion of a metal billet defining the raw material to be worked and the insertion of punches acting symmetrically for compressing the billet, said die having at least one other cavity of a shape corresponding to the shape of one projecting portion of the part to be formed and extending transversely from said central chamber cavity, each cavity adapted for forming a radially projecting portion of the metal part being formed partly in a contact face of one of said die-sectors and partly in a corresponding opposite face of an adjacent one of said die-sectors, each part of said cavity being opened on the die-sector contact face in which it is machined without any clearance, said die having openings therein into said cavities for receiving punches, and a second assembly including punches adapted to penetrate into said die through said openings, said die of said first assembly and said punches of said second assembly defining metal forming parts of said setup, the metal forming parts of one of said assemblies having means for being carried by the piston and table of the press, and the metal forming parts of the other of said assemblies having means for mounting the same on rams operable generally transversely of the direction of relative movement of the table and piston.

2. A setup according to claim 1 including said press with said metal forming parts of said one assembly being mounted on said table and said piston, and a plurality of rams, means mounting said rams for displacement parallel to the path of said piston and for driving said rams along at least part of the working stroke of said piston.

3. A setup according to claim 2 wherein said means mounting said rams include oblique slotted members spaced about said piston axis and clamped between upper and lower plate members urged towards one another.

4. A setup according to claim 2 wherein said die-sectors are carried by said rams and at least certain of said punches are carried by said piston and table.

5. A setup according to claim 4 wherein said punches carried by said table and piston are coaxial with said axis and are adapted for compressing a starting billet, and wherein said means mounting said rams are operable to effect movement of said rams obliquely with respect to said axis.

6. A setup according to claim 2 wherein each die part bearing ram is connected to the press piston through a toggle provided with two levers articulated one relative to the other, the first of said levers further articulated on the ram and the second lever on a sleeve slidingly mounted on the press piston with interposition of a compression spring which urges said sleeve towards the rams, said sleeve being so disposed to apply a pressure onto said rams and to displace said rams when the press piston is moved downwardly, and means for preventing the articulation common to said two levers to appreciable move aside from its position wherein the distance between sliding sleeve and rams is at its maximum, and to subsequently adapt said articulation to move apart and to thus engage under a holding stop when the die-sectors have been brought into contact to each other to lock said sectors parts in said contacting positions.

7. A setup for a press including a piston and a table for cold-forming metal parts of the type having a central body and generally radially extending projecting portions extending outwardly from the central body starting with substantially cylindrical metal billets, said setup comprising a plurality of die-sectors arranged for being brought radially together and coupled along adjacent contact faces to form a die defining a central chamber cavity extending entirely through said die and having a shape corresponding to the shape of the central body of the part to be formed, said contact faces having radiating grooves defining at least one radially extending cavity of a shape corresponding to the shape of a projecting portion of the part to be formed and extending transversely from said central chamber cavity, each radially extending cavity being adapted for forming a radially projecting portion of the metal part being formed partly in a contact face of one of said die-sectors and partly in a corresponding opposite face of an adjacent one of said die-sectors, means for bringing radially together said die-sectors, means for locking said die-sectors in prestressed condition, and punches adapted to penetrate symmetrically into said locked die-sectors into said central chamber, characterized in that at the junction with the central chamber cavity the sections of the grooves formed partly in each contact faces of two adjacent sectors constitute a throat for the extrusion of the metal from said central chamber cavity towards each radially cavity when the die-sectors are brought together and locked in said prestressed condition.

8. A set up according to claim 7 characterized in that at the junction with the central chamber cavity the cross-sections of the radiating grooves are narrowed to make said throat a restricted throat.

9. A set up according to claim 7 characterized in that the extremity of each radially extending cavity opposite to its throat is open.

10. A set up according to claim 9 characterized in that said die includes a plurality of said radiating cavities and said set up includes tools arranged to simultaneously enter said radiating cavities at their extremities opposite to their throats, said tools being operable to drive back the metal to completely fill said cavities.

* * * * *